US005091294A

United States Patent [19]

Nishijima et al.

[11] Patent Number: 5,091,294

[45] Date of Patent: Feb. 25, 1992

[54] SILVER HALIDE COLOR PHOTOGRAPHIC MATERIAL

[75] Inventors: Toyoki Nishijima; Masaki Tanji, both of Tokyo, Japan

[73] Assignee: Konica Corporation, Tokyo, Japan

[21] Appl. No.: 509,879

[22] Filed: Apr. 16, 1990

[30] Foreign Application Priority Data

Apr. 21, 1989 [JP] Japan ..... 64-102902
Dec. 1, 1989 [JP] Japan ..... 64-313705

[51] Int. Cl.[5] ..... G03C 1/34; G03C 7/36; G03C 1/38

[52] U.S. Cl. ..... 430/505; 430/507; 430/546; 430/551; 430/556; 430/557

[58] Field of Search ..... 430/556, 557, 551

[56] References Cited

U.S. PATENT DOCUMENTS 4,327,175 4/1982 Toda et al. ..... 430/557
4,933,271 6/1990 Rody et al. ..... 430/551

FOREIGN PATENT DOCUMENTS 0267491 5/1988 European Pat. Off. ..... 430/557
0283324 9/1988 European Pat. Off. ..... 430/557
3256952 10/1988 Japan ..... 430/557

*Primary Examiner*—Charles L. Bowers, Jr.
*Assistant Examiner*—Lee C. Wright
*Attorney, Agent, or Firm*—Frishauf, Holtz, Goodman & Woodard

[57] ABSTRACT

A silver halide color photographic material that has at least one silver halide emulsion layer on a support, which emulsion layer contains a compound represented by the following general formula (T) and a yellow coupler represented by the following general formula (Y-I):

(T)

(where $R_1$ and $R_2$ are each a hydrogen atom or an alkyl group; $R_3$ and $R_4$ are each a hydrogen atom, an alkyl group, an aryl group or a heterocyclic group; $R_5$ and $R_6$ are each a hydrogen atom, an alkyl group, an aryl group, an acyl group or an alkoxycarbonyl group; X is a divalent group having a carbon atom as a constituent atom of the 6-membered ring; and n is 0, 1 or 2):

(Y-1)

(where $R'_1$ is an alkyl group or a cycloalkyl group; $R'_2$ is an alkyl group, a cycloalkyl group, an acyl group or an aryl group; $R'_3$ is a group capable of substitution on the benzene ring; n' is 0 or 1; Y' is a monovalent ballast group, and Z' is a hydrogen atom or an atom or group that are capable of being eliminated upon coupling).

24 Claims, No Drawings

SILVER HALIDE COLOR PHOTOGRAPHIC MATERIAL

BACKGROUND OF THE INVENTION

The present invention relates to a silver halide color photographic material and a method for processing it. More particularly, the present invention relates to a silver halide color photographic material that has good image keeping quality, that can be processed efficiently at elevated temperatures and that produces satisfactory colors.

Yellow, magenta and cyan couplers used in silver halide color photographic materials, say, color prints, that are intended for direct viewing have basic requirements for performance to satisfy such as the keeping quality of dye images. In recent years, an increasing demand has arisen for providing improved color reproduction in order to achieve faithful reproduction of the colors of an object of interest.

Yellow couplers have had the problem of insufficient reproduction of yellow and orange colors on account of the unwanted absorption of color forming dyes at wavelengths longer than 500 nm. To deal with this problem, various attempts have been proposed with respect to the improvement of couplers and the addition of tone modifiers. For instance, Japanese Patent Public Disclosure Nos. 241547/1988 and 256952/1988 proposed methods that are capable of providing satisfactory colors. However, these methods are incapable of sufficiently lightfast images unless anti-fading agents are added. Although various antifading agents have been proposed, their use causes two big problems. First, the effectiveness of tone modifiers is reduced. Second, the density of a yellow image increases during heat treatments (heat treatments were performed during laminating or sticking a color print), producing a yellowish appearance in the heated area.

Under these circumstances, it has been desired to develop a method for producing a yellow image that has satisfactory color, that is lightfast and that will not experience an increase in density during heat treatments. As a result of the extensive studies conducted to meet this need, the present inventors found that the aforementioned problems of the prior art could be solved by using a specified yellow coupler in combination with a specified anti-fading agent.

SUMMARY OF THE INVENTION

A first object, therefore, of the present invention is to provide a silver halide color photographic material capable of forming a yellow dye image that has less of the unwanted absorption in the longer wavelength range and that will not experience an increase in density during heat treatments.

A second object of the present invention is to provide a silver halide color photographic material capable of forming a yellow dye image that has improved color fastness to light and a satisfactory yellow color.

These objects of the present invention can be attained by a silver halide color photographic material that has at least one silver halide emulsion layer on a support, which emulsion layer contains a compound represented by the following general formula (T) and a yellow coupler represented by the following general formula (Y-I):

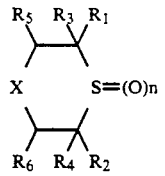

(T)

(where $R_1$ and $R_2$ are each a hydrogen atom or an alkyl group; $R_3$ and $R_4$ are each a hydrogen atom, an alkyl group, an aryl group or a heterocyclic group; $R_5$ and $R_6$ are each a hydrogen atom, an alkyl group, an aryl group, an acyl group or an alkoxycarbonyl group; X is a divalent group having a carbon atom as a constituent atom of the 6-membered ring; and n is 0, 1 or 2):

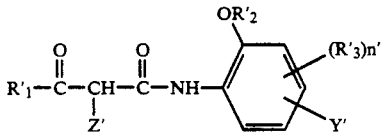

(Y-1)

(where $R'_1$ is an alkyl group or a cycloalkyl group; $R'_2$ is an alkyl group, a cycloalkyl group, an acyl group Or an aryl group; $R'_3$ is a group capable of substitution on the benzene ring; n' is 0 or 1; Y' is a monovalent ballast group, and Z' is a hydrogen atom or an atom or group that is capable of being eliminated upon coupling).

DETAILED DESCRIPTION OF THE INVENTION

The compound represented by the general formula (T) is described below in detail. The alkyl group represented by $R_1$ or $R_2$ is preferably a methyl group. The alkyl group represented by $R_3$–$R_6$ preferably has 1–4 carbon atoms. The aryl group represented by $R_3$–$R_6$ is preferably a phenyl group. The heterocyclic group represented by $R_3$ or $R_4$ is preferably a thienyl group. The alkoxycarbonyl group represented by $R_5$ or $R_6$ preferably has 2–19 carbon atoms. The acyl group represented by $R_5$ and $R_6$ is preferably an acetyl group or a benzoyl group.

Each of the groups represented by $R_3$–$R_6$ may have a substituent. When $R_3$ and $R_4$ are each a phenyl group, preferred substituents include a halogen atom, an alkyl group of 1–8 carbon atoms, a phenyl group, a cyclohexyl group, an alkoxy group having 1–18 carbon atoms, a phenylalkyl group having 7–9 carbon atoms, and a hydroxyl group. When $R_5$ and $R_6$ are each an alkyl group, preferred substituents include a hydroxyl group, a phenyl group, an alkoxy group having 1–12 carbon atoms, a benzoyloxy group, and an alkylcarbonyloxy group having 2–18 carbon atoms.

Preferred examples of the divalent group represented by X include

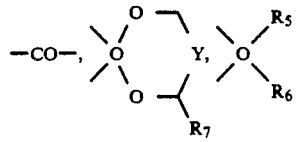

>C=N—NH—R' (R' is acyl group), wherein $R_7$ is a hydrogen atom, an alkyl group having 1–4 carbon atoms or —$CH_2OR_{10}$ (where $R_{10}$ is a hydrogen atom or an acyl group); Y is a simple bond or

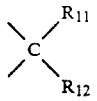

(where $R_{11}$ is a hydrogen atom, an alkyl group having 1–4 carbon atoms or —$CH_2OR_{14}$ (where $R_{14}$ is a hydrogen atom or an acyl group), and $R_{12}$ is a hydrogen atom or an alkyl group having 1–4 carbon atoms); $R_8$ is a hydrogen atom, a methyl group, a phenyl group,

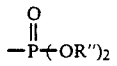

(R″ is an alkyl group having 1–4 carbon atoms), an aryloxy group a benzyloxy group, an alkoxy group having 1–12 carbon atoms, or a carbamoyl group; $R_9$ is a hydrogen atom, a hydroxyl group, an aryloxy group, a benzyloxy group, an alkoxy group having 1–12 carbon atoms, an acyloxy group or an acylamino group. $R_8$ and $R_9$ may combine to form a ring.

The acyl group in the acyloxy or acylamino group represented by $R_9$, the acyl group represented by $R_{10}$ or $R_{14}$, and the acyl group in the

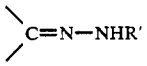

(R′ is acyl group) represented by X may be a benzoyl group an alkylcarbonyl group having 2–18 carbon atoms. Preferred examples of these acyl groups include:

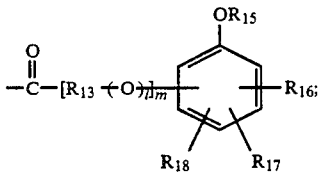

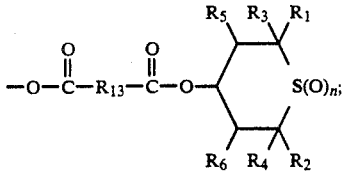

-continued

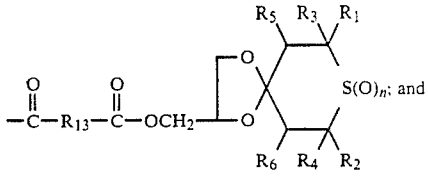

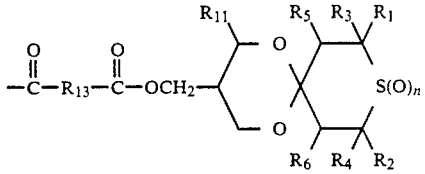

where $R_1$–$R_6$, $R_{11}$ and n have the same meanings as already defined; l and m are each 0 or 1, provided m≧l; $R_{13}$ is a simple bond or a divalent bond such as an alkylene group having 1–14 carbon atoms or an

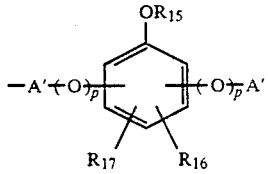

group (each independently P is 0 or 1 and each independently A′ is an alkylene group); $R_{15}$ is a hydrogen atom, an alkyl group (preferably an alkyl group having 1–8 carbon atoms), an acyl group, an alkoxyoxalyl group, a sulfonyl group or a carbamoyl group, and $R_{16}$ and $R_{17}$ are each a hydrogen atom, an alkyl group or an aryl group; and $R_{18}$ is a hydrogen atom, —$OR_{15}$,

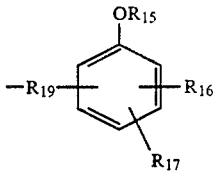

[where $R_{15}$, $R_{16}$ and $R_{17}$ are the same as defined above, and $R_{19}$ is —O—, —S—, —S—S— or

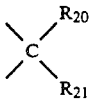

(where $R_{20}$ and $R_{21}$ are each a hydrogen atom or an alkyl group)].

Specific example of the compound represented by the general formula (T) are listed below.

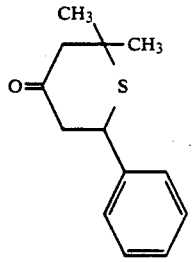
T-1
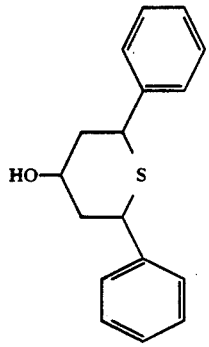
T-2
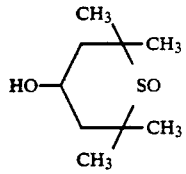
T-3
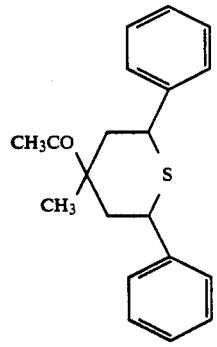
T-4
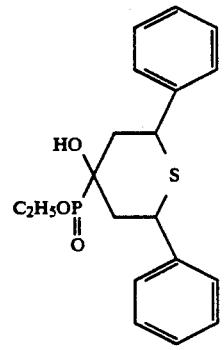
T-5

-continued
T-6
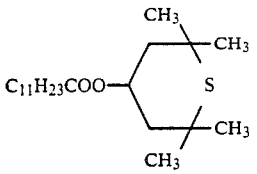
T-7
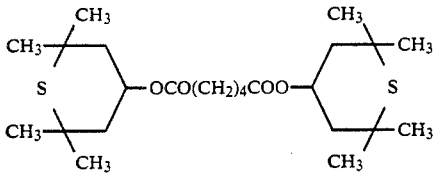
T-8
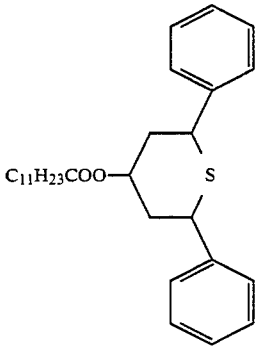
T-9
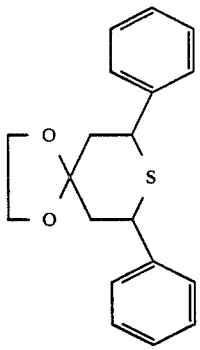
T-10
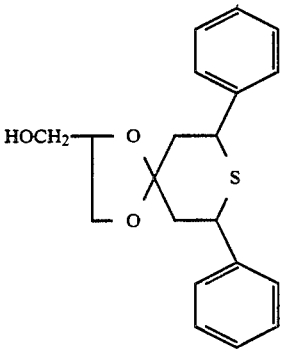

-continued
T-11
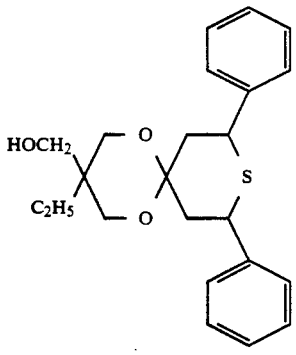
T-12
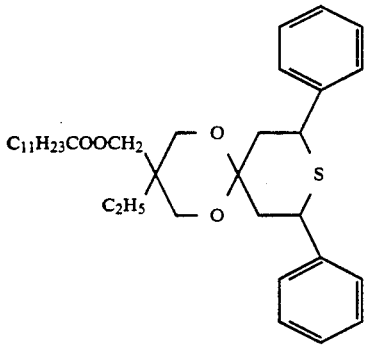
T-13
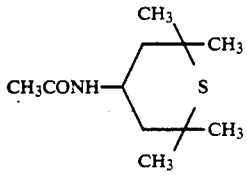
T-14
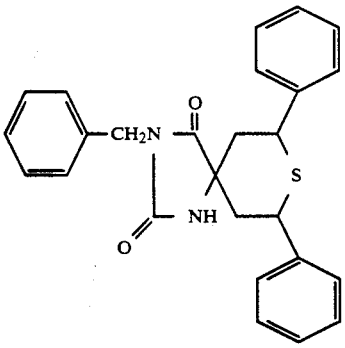
T-15
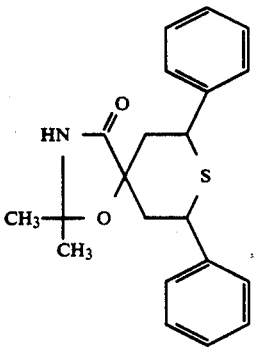

-continued
T-16
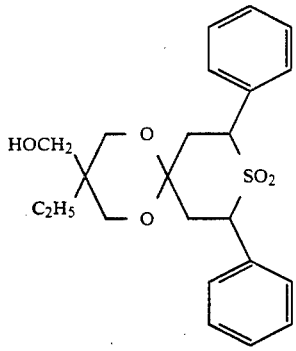
T-17
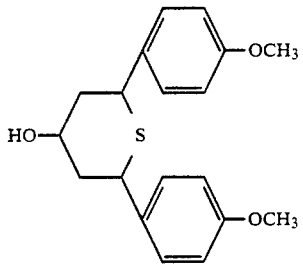
T-18
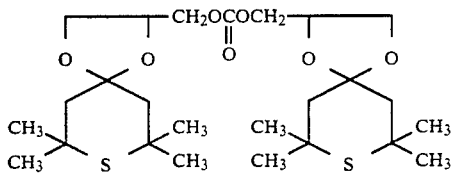
T-19
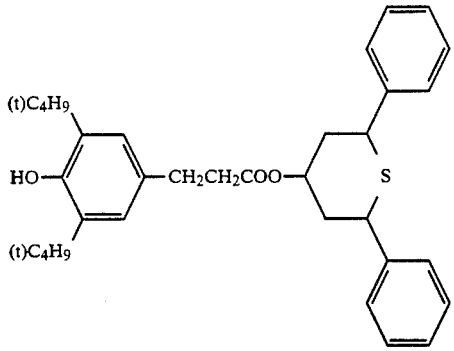
T-20
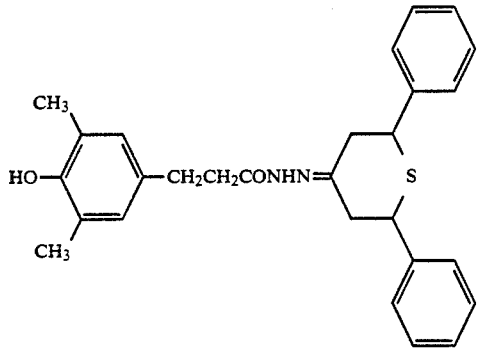

-continued
T-21
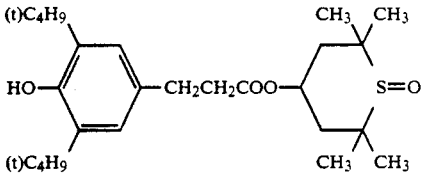
T-22
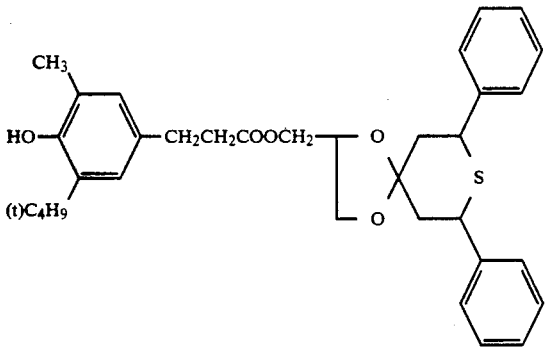
T-23
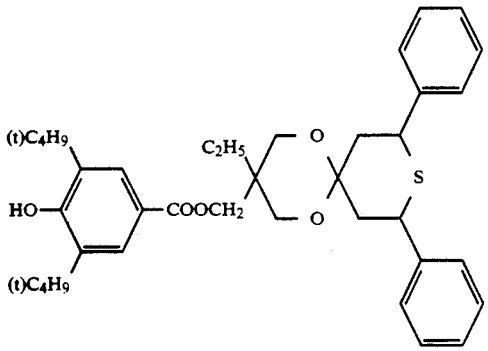
T-24
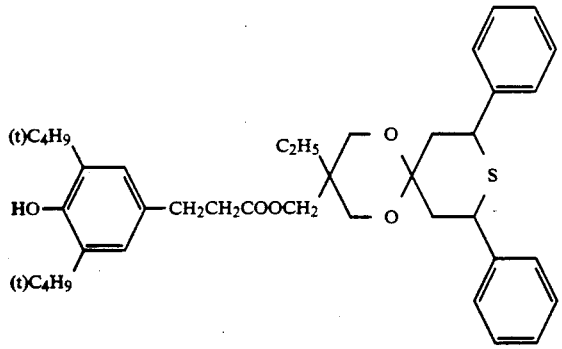
T-25
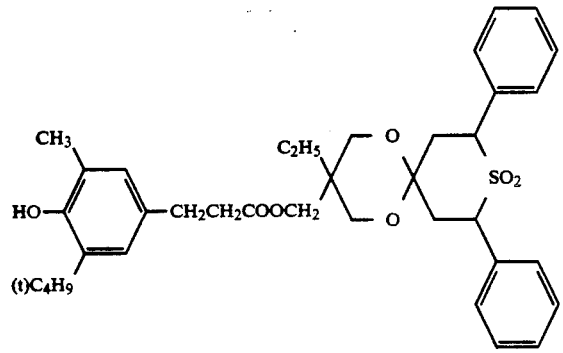

-continued
T-26
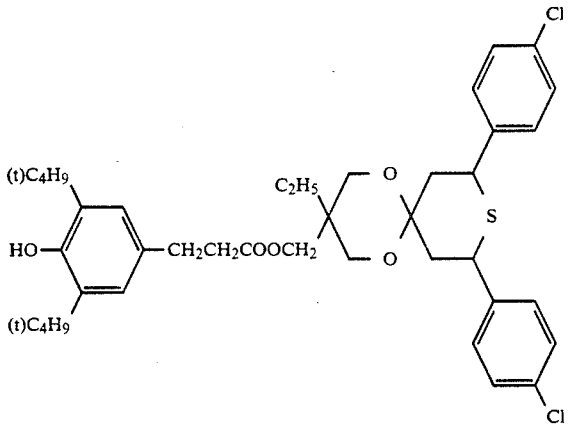
T-27
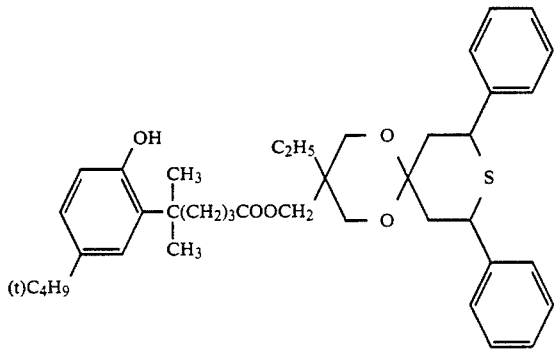
T-28
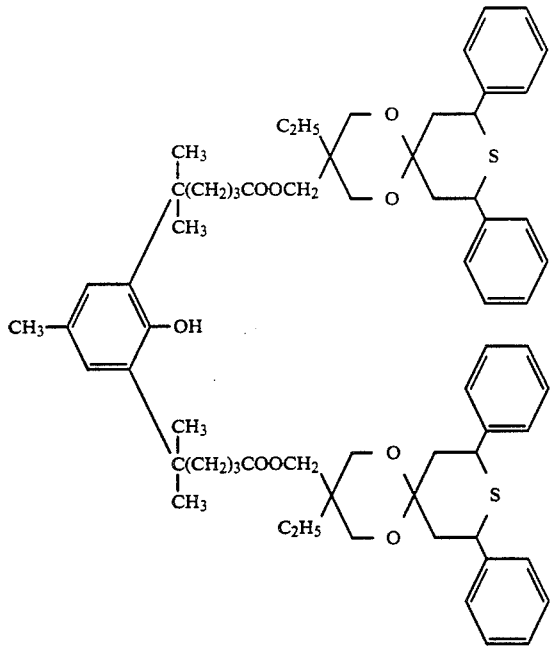

-continued

T-29

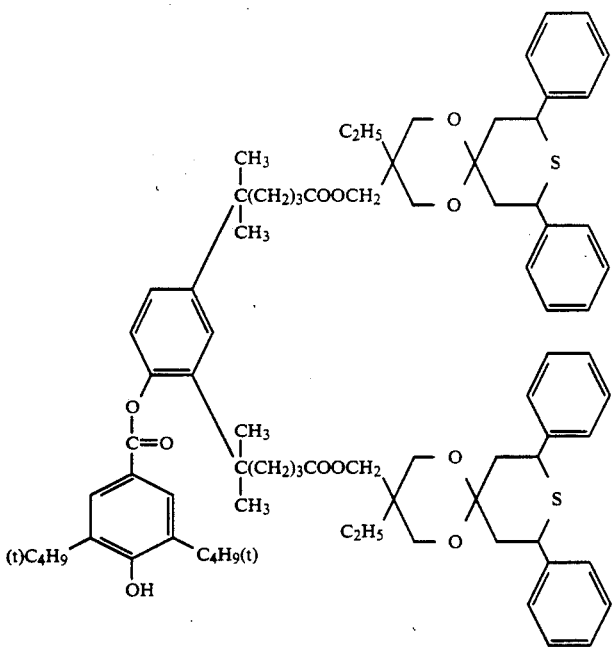

T-30

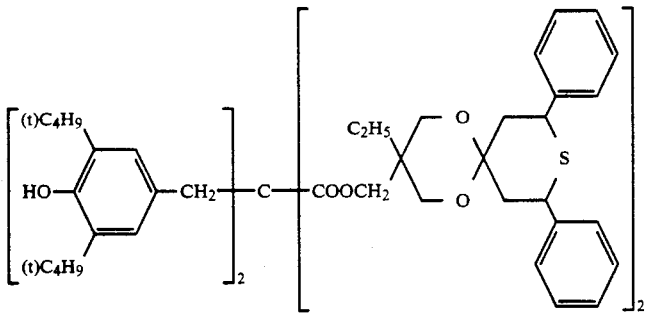

T-31

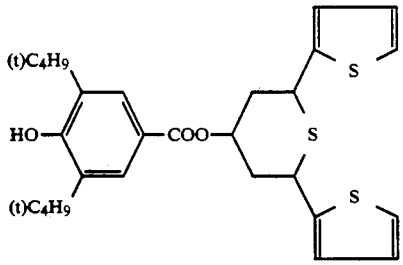

The compounds of the general formula (T) can be synthesized by known methods, such as the acylation of 4-hydroxytetrahydrothiopyrane compounds with acid chlorides, and the reaction of 4-ketotetrahydrothiopyrane compounds with diols to produce 1,5-dioxa-9-thiaspiro[5,5]-undecane compounds or 1,4-dioxa-8-thiaspiro[4,5]-decane compounds.

In accordance with the present invention, the compounds of the general formula (T) are incorporated in a light-sensitive material, particularly in a silver halide emulsion layer containing a yellow coupler represented by the general formula (Y-I). Preferably, they are incorporated in accordance with the disclosures in U.S. Pat. Nos. 2,322,027, 2,801,170, 2,801,171, 2,272,191 and 2,304,940. That is the compound of the general formula (T) and the coupler of the general formula (Y-I) are dissolved or dispersed in high-boiling point solvents, which may be used together with low-boiling point solvents as required, and the resulting solution or dispersion is added to a hydrophilic colloidal solution. If necessary, other couplers, hydroquinone derivatives, uv absorbers, known agents capable of preventing the fading of dye images, and other additives may also be used. Known agents capable of preventing the fading of dye images include those compounds which are described in Japanese Patent Public Disclosure No. 143754/1986. The compounds of the general formula (T) may be used either on their own or as admixtures.

The compounds of the general formula (T) are preferably added in amounts not greater than 1.5 g/m$^2$, with the range of 0.01–0.6 g/m$^2$ being particularly preferred.

The yellow coupler to be used in the present invention is represented by the following general formula (Y-I):

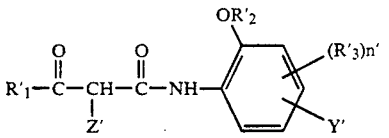

(Y-1)

where $R'_1$ is an alkyl group or a cycloalkyl group; $R'_2$ is an alkyl group, a cycloalkyl group, an acyl group or an aryl group; $R'_3$ is a group capable of substitution on the benzene ring; n' is 0 or 1; Y' is a monovalent ballast group; and Z' is a hydrogen atom or an atom or group that is capable of being eliminated upon coupling.

The alkyl group represented by $R'_1$ may be straight-chained or branched and is exemplified by methyl, ethyl, isopropyl, t-butyl, dodecyl, etc. These alkyl groups may have a substituent such as a halogen atom or a group such as aryl, alkoxy, aryloxy, alkylsulfonyl, acylamino or hydroxy. The cycloalkyl group represented by $R'_1$ may be exemplified by cyclopropyl, cyclohexyl or adamantyl. A preferred example of $R'_1$ is a branched alkyl group.

The alkyl group and cycloalkyl group represented by $R'_2$ may be exemplified by the same groups as $R'_1$, and the aryl group represented by $R'_2$ is exemplified by group. The alkyl, cycloalkyl and aryl groups represented by $R'_2$ may have a substituent that may be the same as for $R'_1$. The acyl group represented by $R'_2$ may be exemplified by acetyl, propionyl, butyryl, hexanoyl, benzoyl, etc. Preferred examples of $R'_2$ are alkyl and aryl groups, with the alkyl group being more preferred.

There is no particular limitation on $R'_3$ as long as it is capable of being substituted on the benzene ring. Specific examples of $R'_3$ include: a halogen atom (e.g. Cl), an alkyl group (e.g. ethyl, i-propyl or t-butyl), an alkoxy group (e.g. methoxy), and aryloxy group (e.g. phenyloxy), an acyloxy group (e.g. methylcarbonyloxy or benzoyloxy), an acylamino group (e.g. acetamido or phenylcarbonylamino), a carbamoyl group (e.g. N-methylcarbamoyl or N-phenylcarbamoyl), an alkylsulfonamido group (e.g. ethylsulfonylamino), an arylsulfonamido group (e.g. phenylsulfonylamino), a sulfamoyl group (e.g. N-propylsulfamoyl or N-phenylsulfamoyl) and an imido group (e.g. succinimide or glutarimide group).

In the general formula (Y-I), Z' represents a group that is capable of being eliminated upon coupling reaction with the oxidation product of a developing agent, such as a group represented by the following general formula (Y-II) or (Y-III):

$$-OR'_{10} \qquad \text{(Y-II)}$$

(where $R'_{10}$ is an optionally substituted aryl or heterocyclic group);

$$-N \qquad Z_1 \qquad \text{(Y-III)}$$

(where $Z_1$ represents the non-metallic atomic group necessary to form a 5- or 6-membered ring in cooperation with the nitrogen atom). Examples of the non-metallic atomic group include methylene, methine, substituted methine,

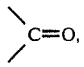

—NH—, —N=, —O—, —S— an —$SO_2$—.

The yellow coupler represented by the general formula (Y-I) is typically used in an amount ranging from $1\times10^{-3}$ to 1 mole, preferably from $1\times10^{-2}$ to $8\times10^{-1}$ moles, per mole of silver halide.

Specific examples of the yellow coupler represented by the general formula (Y-I) are listed below.

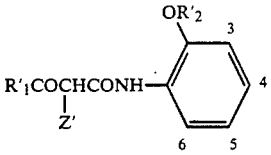

| No. | $R'_1$ | $R'_2$ | Z' |
|---|---|---|---|
| Y-1-1 | (t)$C_4H_9$— | —$CH_3$ | 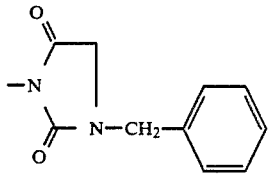 |
| Y-1-2 | (t)$C_4H_9$— | —$CH_3$ | 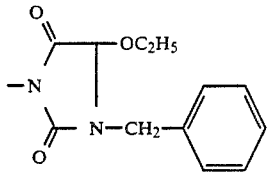 |

-continued
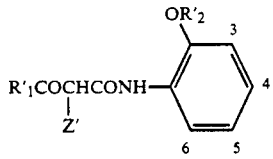
| | | | |
|---|---|---|---|
| Y-1-3 | (t)$C_4H_9$— | —$CH_3$ | 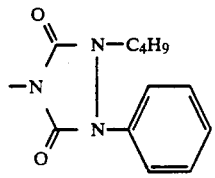 |
| Y-1-4 | (t)$C_4H_9$— | —$CH_3$ | 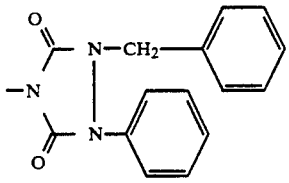 |
| Y-1-5 | (t)$C_4H_9$— | —$CH_3$ | 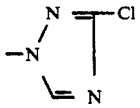 |
| Y-1-6 | (t)$C_4H_9$— | —$CH_3$ | 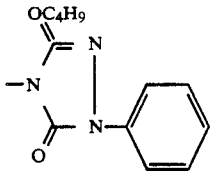 |
| Y-1-7 | (t)$C_4H_9$— | —$C_3H_7$(iso) | 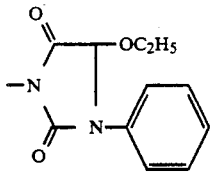 |
| Y-1-8 | (t)$C_4H_9$— | —$CH_3$ | 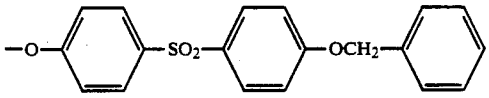 |
| Y-1-9 | (t)$C_4H_9$— | —$C_{12}H_{25}$ | 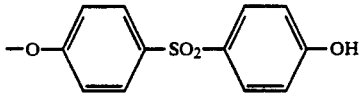 |
| Y-1-10 | (t)$C_4H_9$— | —$C_{18}H_{37}$ | 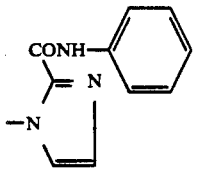 |
| Y-1-11 | (t)$C_4H_9$— | —$CH_3$ | 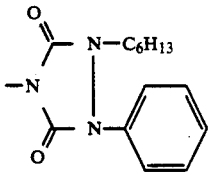 |

-continued
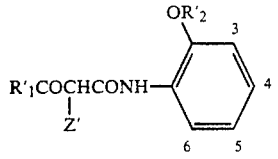
| | | | |
|---|---|---|---|
| Y-1-12 | (t)$C_4H_9$— | —$C_4H_9$ | 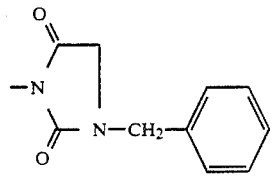 |
| Y-1-13 | (t)$C_4H_9$— | —$CH_3$ | 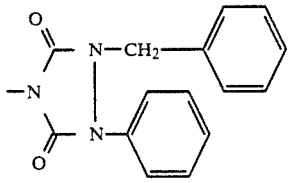 |
| Y-1-14 | (t)$C_4H_9$— | —$CH_3$ | 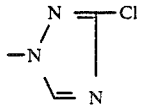 |
| Y-1-15 | (t)$C_4H_9$— | —$CH_3$ | 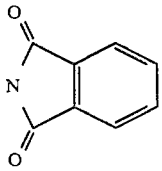 |
| Y-1-16 | (t)$C_4H_9$— | —$CH_3$ | 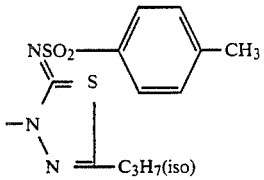 |
| Y-1-17 | $C_2H_5OCH_2C(CH_3)_2$— | —$CH_3$ | 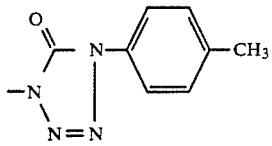 |
| Y-1-18 | (t)$C_4H_9$— | —$CH_3$ | 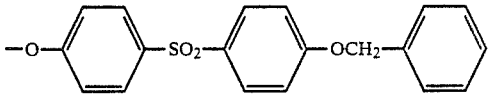 |
| Y-1-19 | (t)$C_4H_9$— | —$CH_3$ | 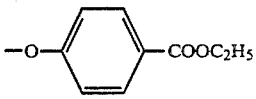 |
| Y-1-20 | (t)$C_4H_9$— | —$C_{12}H_{25}$ | 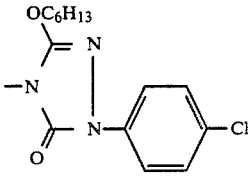 |

-continued
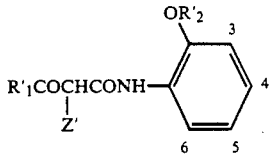
| | | | |
|---|---|---|---|
| Y-1-21 | (t)$C_4H_9$— | —$C_2H_5$ | 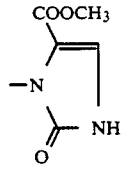 |
| Y-1-22 | 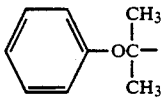 | —$C_4H_9$ | 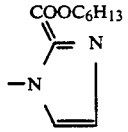 |
| Y-1-23 | (t)$C_5H_{11}$ | —$C_2H_5$ | H |
| Y-1-24 | (t)$C_4H_9$— | —$CH_3$ | 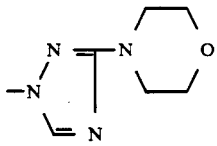 |
| Y-1-25 | (t)$C_4H_9$— | —$C_{16}H_{37}$ | 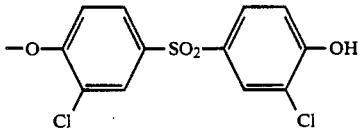 |
| Y-1-26 | (t)$C_4H_9$— | —$CH_3$ | 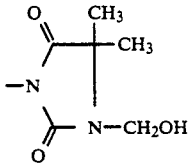 |
| Y-1-27 | (t)$C_4H_9$— | —$CH_3$ | 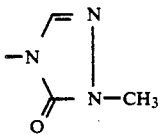 |
| Y-1-28 | (t)$C_4H_9$— | —$CH_3$ | 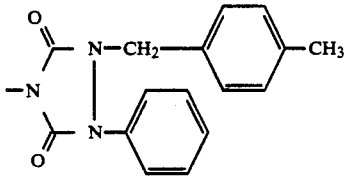 |
| Y-1-29 | 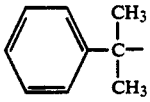 | —$C_{12}H_{25}$ | 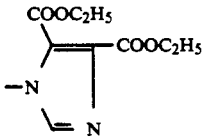 |
| Y-1-30 | (t)$C_5H_{11}$— | —$CH_3$ | 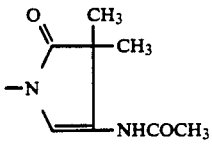 |

-continued
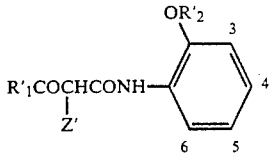
| | | | |
|---|---|---|---|
| Y-1-31 | (t)$C_4H_9$— | —$CH_3$ | 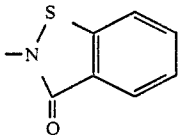 |
| Y-1-32 | (t)$C_4H_9$— | —$CH_3$ | 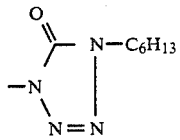 |
| Y-1-33 | (t)$C_4H_9$— | —$CH_3$ | 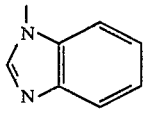 |
| Y-1-34 | (t)$C_4H_9$— | 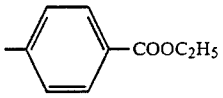 | 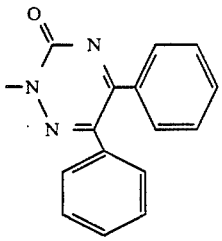 |
| Y-1-35 | (t)$C_4H_9$— | —$C_4H_9$ | 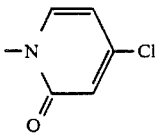 |
| Y-1-36 | (t)$C_4H_9$— | —$CH_3$ | 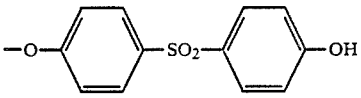 |
| Y-1-37 | (t)$C_4H_9$— | 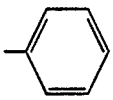 | 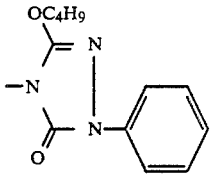 |
| Y-1-38 | (t)$C_5H_{11}$— | —$\overset{O}{\overset{\|\|}{C}}CH_3$ | 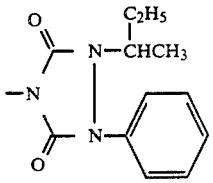 |

-continued
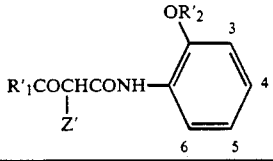
| | | | |
|---|---|---|---|
| Y-1-39 | (t)$C_4H_9$— | —$CC_2H_5$ (O) | 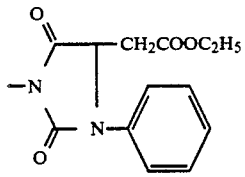 |
| Y-1-40 | (t)$C_4H_9$— | —$CH_3$ | 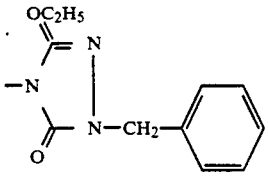 |
| Y-1-41 | (t)$C_4H_9$— | —$CH_3$ | 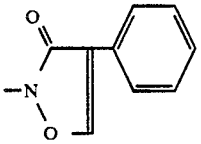 |
| Y-1-42 | (t)$C_4H_9$— | —$CH_3$ | 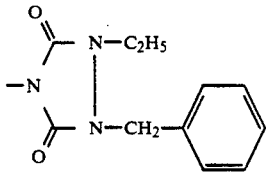 |
| Y-1-43 | (t)$C_4H_9$— | —$CH_3$ | 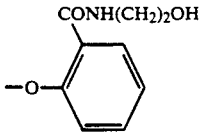 |
| Y-1-44 | 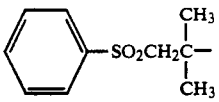 | —$C_2H_5$ | 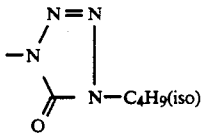 |
| Y-1-45 | (t)$C_4H_9$— | 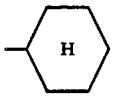 | 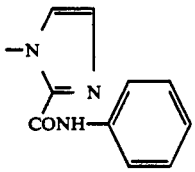 |
| Y-1-46 | 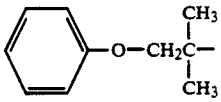 | —$CH_3$ | 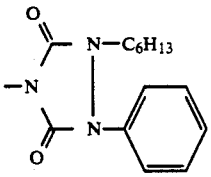 |

-continued
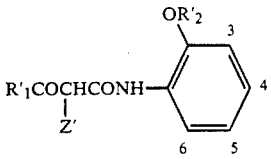
| | | | |
|---|---|---|---|
| Y-1-47 | (iso)$C_3H_7$— | —$C_4H_9$ | 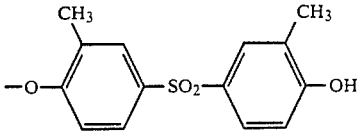 |
| Y-1-48 | 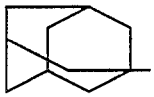 | —$CH_3$ | 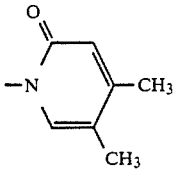 |
| Y-1-49 | 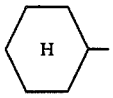 | —$CH_3$ | 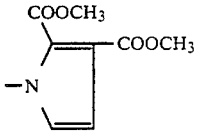 |
| Y-1-50 | (t)$C_4H_9$— | —$CH_3$ | 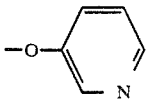 |
| Y-1-51 | (t)$C_4H_9$— | —$C_{16}H_{33}$ | 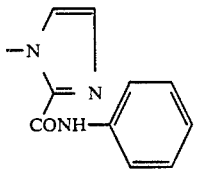 |
| No. | 3-position | 4-position | 5-position | 6-position |
|---|---|---|---|---|
| Y-1-1 | —H | —H | 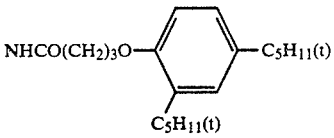 | —H |
| Y-1-2 | —H | —H | 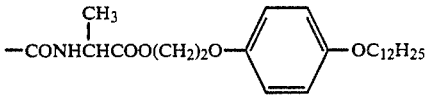 | —H |
| Y-1-3 | —H | —H | 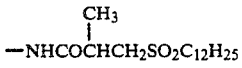 | —H |
| Y-1-4 | —H | —H | 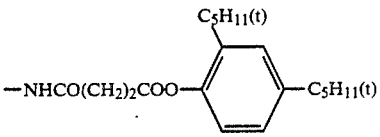 | —H |

-continued
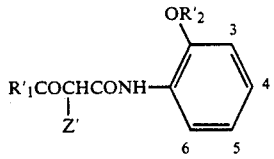
| | | | | |
|---|---|---|---|---|
| Y-1-5 | —H | —H | $-N(CH_2C_6H_5)-COCH(CH_3)CH_2SO_2C_{18}H_{37}$ | —H |
| Y-1-6 | —H | —H | $-NHCO(CH_2)_2CONH_{12}H_{25}$ ($C_2H_5$) | —H |
| Y-1-7 | —H | —H | $-CONH(CH_2)_3CONH-C_6H_4-C_{12}H_{25}$ | —H |
| Y-1-8 | —H | —H | $-CONH-C_6H_4-NHCOC_{12}H_{25}$ | —H |
| Y-1-9 | —H | —H | $-CONHCH(CH_3)CH_2SO_2C_2H_5$ | —H |
| Y-1-10 | —H | —H | $-NHCOC(CH_3)_2CH_2SO_2C_4H_9$ | —H |
| Y-1-11 | —H | —H | $-NHCOCH(CH_3)NHCO-C_6H_4-OC_{12}H_{25}$ | —H |
| Y-1-12 | —H | —H | $-NHCOCH(C_{12}H_{25})O-C_6H_4-SO_2NHC_4H_9$ | —H |
| Y-1-13 | —H | —H | $-CONH(CH_2)_2NHSO_2C_{12}H_{25}$ | —H |
| Y-1-14 | —H | —H | $-CONHCH(CH_3)CH_2SO_2CH_2CH(C_6H_{13})C_8H_{17}$ | —H |
| Y-1-15 | —H | —H | $-SO_2NH(CH_2)_3O-C_6H_3(C_5H_{11}(t))-C_5H_{11}(t)$ | —H |
| Y-1-16 | —H | —H | $-NHCOCH(CH_3)(CH_2)_2NHCO-C_6H_4-OC_{12}H_{25}$ | —H |
| Y-1-17 | —H | —H | $-NHCO(CH_2)_{10}COOC_2H_5$ | —H |

-continued

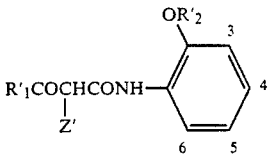

| | | | | |
|---|---|---|---|---|
| Y-1-18 | —H | —H | —CONH—$C_6H_4$—$SO_2NHC_{12}H_{25}$ | —H |
| Y-1-19 | —H | —H | —NHCO(C$_{12}$H$_{25}$)CHO—$C_6H_3$(OH)($C_4H_9$(t)) | —H |
| Y-1-20 | —H | —H | —NHCO$(CH_2)_2SO_2NHCH_2CH(C_2H_5)C_4H_9$ | —H |
| Y-1-21 | —H | —Cl | —NHCO(CH$_3$)$_2$CH$_2$SO$_2$—$C_6H_3$($OC_4H_9$)($C_8H_{17}$(t)) | —H |
| Y-1-22 | —H | —H | —$NHSO_2C_{16}H_{33}$ | —H |
| Y-1-23 | —H | —H | —NHCO(CH$_3$)CH$(CH_2)NHSO_2$—$C_6H_4$—$OC_5H_{10}$ | —H |
| Y-1-24 | —H | —H | —$NHSO_2(CH_2)_3O$—$C_6H_3$($C_5H_{11}$(t))($C_5H_{11}$(t)) | —H |
| Y-1-25 | —H | —H | —$NHCO(CH_2)_2NHSO_2N(CH_3)$—$C_6H_5$ | —H |
| Y-1-26 | —H | —H | —$CONH(CH_2)_4NHCO$—$C_6H_3$($OC_{12}H_{25}$)($CH_3$) | —H |
| Y-1-27 | —H | —H | —CONHCH($C_6H_{13}$)$CH_2SO_2NHC_{12}H_{25}$ | —H |
| Y-1-28 | —H | —H | —$COOC_{12}H_{25}$ | —H |
| Y-1-29 | —H | —H | —$NHCO(CH_2)_3NHCONHCH_2CH(C_2H_5)C_4H_9$ | —H |

-continued

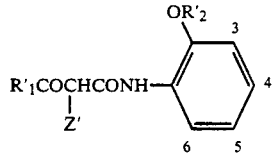

| | | | | |
|---|---|---|---|---|
| Y-1-30 | —H | —H | —CONHCHCH$_2$CONH—(C$_6$H$_{13}$)—OC$_4$H$_9$ | —H |
| Y-1-31 | —H | —H | —COOC$_{18}$H$_{35}$ | —H |
| Y-1-32 | —H | —H | —NHCO(CH$_2$)$_3$NHCOCH$_2$CHC$_6$H$_{13}$ (C$_8$H$_{17}$) | —H |
| Y-1-33 | —H | —Cl | —NHCOC(CH$_3$)$_2$CH$_2$NHCON(C$_{12}$H$_{25}$)(C$_2$H$_5$) | —H |
| Y-1-34 | —H | —H | —CONHCH$_2$CHSO—(C$_2$H$_5$)—C$_{18}$H$_{37}$ | —H |
| Y-1-35 | —H | —NHCOCHSO$_2$NHC$_{12}$H$_{25}$ (C$_{16}$H$_{33}$) | —Cl | —H |
| Y-1-36 | —H | —Cl | —NHCO(CH$_2$)$_2$NHCO—C$_{12}$H$_{25}$ | —H |
| Y-1-37 | —H | —H | —CONHC(CH$_2$)$_2$CH$_2$CONH—OC$_{12}$H$_{25}$ | —H |
| Y-1-38 | —H | —OCH$_3$ | —NHCOCH(CH$_2$)$_2$NHSO$_2$—(OC$_{12}$H$_{25}$)—CH$_3$ | —H |
| Y-1-39 | —H | —H | —COOCHCOOC$_{12}$H$_{25}$ (CH$_3$) | —H |
| Y-1-40 | —H | —H | —CONHC(CH$_3$)$_2$(CH$_2$)$_2$COO—CH$_3$ | —H |
| Y-1-41 | —H | —CONH(CH$_2$)$_4$NHSO$_2$CH(CH$_3$)C$_4$H$_9$ | —OCH$_3$ | —H |
| Y-1-42 | —H | —H | —CONH—SO$_2$NHC$_{12}$H$_{25}$ | —H |
| Y-1-43 | —H | —H | —COOCHCOOC$_{12}$H$_{25}$ (C$_4$H$_9$) | —H |

-continued

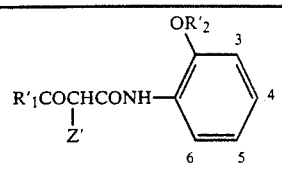

| | | | | |
|---|---|---|---|---|
| Y-1-44 | —H | —H | —NHCO(CH2)3CON—C6H13 \| CH2 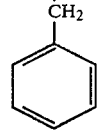 | —H |
| Y-1-45 | —H | —H | 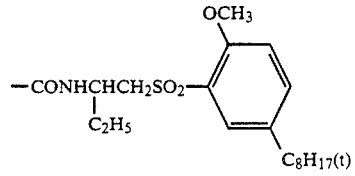  | —H |
| Y-1-46 | —H | —H | —CONHCHCOOC12H25 \| C2H5 | —H |
| Y-1-47 | —H | —H | 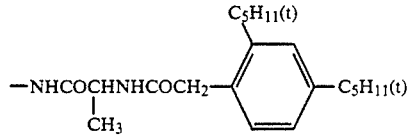  | —H |
| Y-1-48 | —H | —H | —NHCO(CH2)10COOC2H5 | —H |
| Y-1-49 | —H | —H | 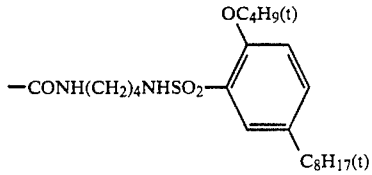  | —H |
| Y-1-50 | —H | —H | 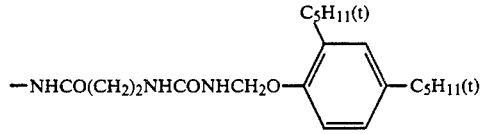  | —H |
| Y-1-51 | —H | —H | —SO2NHCOC2H5 | —H |

The "high-boiling point organic solvents" which are used to disperse couplers and other photographic additives are organic solvents that boil at temperatures not lower than 150° C. There is no particular limitation on the high-boiling point organic solvents that can be used in the present invention, and they may be exemplified by esters such as phthalate esters, phosphate esters and benzoate esters, as well as organic acid amides, ketones and hydrocarbon compounds. Preferred high-boiling point organic solvents are those which have dielectric constants of no higher than 61.0° at 30° C., and more preferred are those which have dielectric constants of 1.9–6.0 at 30° C. and vapor pressures of no higher than 0.5 mmHg at 100° C. Phthalate esters and phosphate esters are particularly preferred. These high-boiling point organic solvents may be used either on their own or as admixtures.

The phthalate esters that are used with advantage in the present invention are represented by the following general formula (S-1):

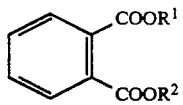

(S-1)

where $R^1$ and $R^2$ each represents an alkyl group, an alkenyl group or an aryl group, provided the total sum of carbon atoms in the group represented by $R^1$ and $R^2$ ranges from 12 to 32, preferably from 16 to 24, more preferably from 18 to 24.

The alkyl group represented by $R^1$ and $R^2$ in the general formula (S-1) may be straight-chained or branched and may be exemplified by butyl, pentyl, hexyl, 2-ethylhexyl, 3,5,5-trimethylhexyl, octyl, nonyl, decyl, dodecyl, tetradecyl, hexadecyl, octadecyl, etc. The aryl group represented by $R^1$ and $R^2$ may be exemplified by phenyl, naphthyl, etc. The alkenyl group represented by $R^1$ and $R^2$ may be exemplified by hexenyl, heptenyl, octadecenyl, etc. These alkyl, alkenyl and aryl groups may have one or more substituents. Exemplary substituents for the alkyl and alkenyl groups include a halogen atom, an alkoxy group, an aryl group, an aryloxy group, an alkenyl group, an alkoxycarbonyl group, etc. Substituents for the aryl group include a halogen atom, an alkyl group, an alkoxy group, an aryl group, an aryloxy group, an alkenyl group, an alkoxycarbonyl group. etc.

In the general formula (S-1), $R^1$ and $R^2$ preferably represent an alkyl group such as 2-ethylhexyl, 3,5,5-trimethylhexyl, n-octyl or n-nonyl.

The phosphate esters that are used with advantage in the present invention are represented by the following general formula (S-2):

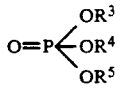

(S-2)

where $R^3$, $R^4$ and $R^5$ each independently represents an alkyl group, an alkenyl group or an aryl group, provided the total sum of carbon atoms in the groups represented by $R^3$, $R^4$ and $R^5$ ranges preferably from 24 to 54, more preferably from 27 to 36.

The alkyl group represented by $R^3$, $R^4$ and $R^5$ in the general formula (S-2) may be exemplified by butyl, pentyl, hexyl, 2-ethylhexyl, heptyl, nonyl, decyl, dodecyl, tetradecyl, hexadecyl, octadecyl, nonadecyl, etc. The aryl group represented by $R_3$, $R_4$ and $R_5$ may be exemplified by phenyl and naphthyl. The alkenyl group represented by $R^3$, $R^4$ and $R^5$ in the general formula (S-1) may be exemplified by hexenyl, heptenyl, octadecenyl, etc.

These alkyl, alkenyl and aryl groups may have one or more substituents. Preferably, $R^3$, $R^4$ and $R^5$ each represents an alkyl group as exemplified by 2-ethylnexyl, n-octyl, 3,5,5-trimethylhexyl, n-nonyl, n-decyl, sec-decyl, sec-dodecyl, t-octyl, etc.

Typical examples of the high boiling point organic solvent that are preferably used in the present invention are listed specifically below, to which the present invention is by no means limited.

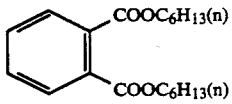

S-1

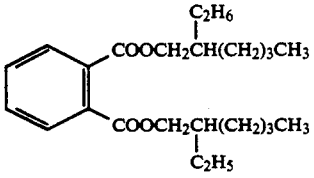

S-2

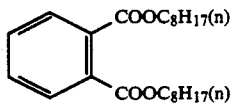

S-3

-continued

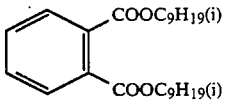

S-4

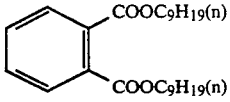

S-5

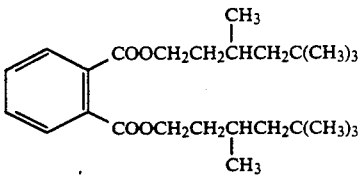

S-6

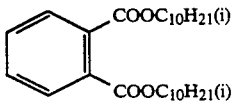

S-7

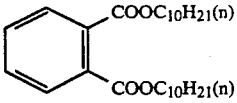

S-8

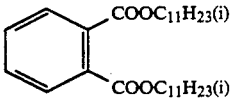

S-9

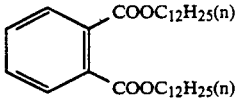

S-10

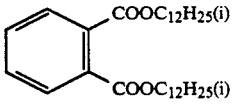

S-11

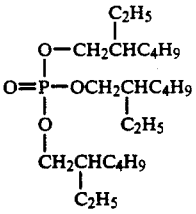

S-12

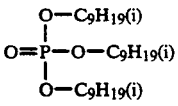

S-13

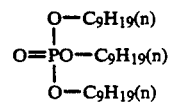

S-14

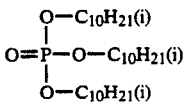

S-15

-continued

S-16

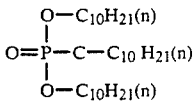

S-17

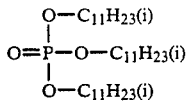

S-18

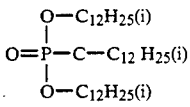

S-19

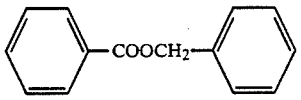

S-20

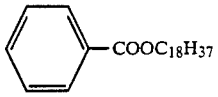

S-21

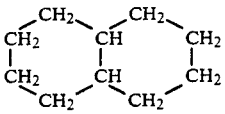

S-22

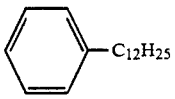

Another example of the high-boiling point organic solvent that may be used with advantage in the present invention is represented by the following general formula (TO):

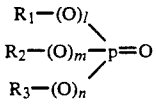

(TO)

where $R_1$, $R_2$ and $R_3$ each independently represents an alkyl group or an aryl group; l, m and n are each 0 or 1, provided they do not assume the value "1" at the same time.

The alkyl group represented by $R_1$, $R_2$ and $R_3$ may be straight-chained, branched or cyclic, and it may optionally have a substituent. Unsubstituted alkyl groups may have 1-20 carbon atoms, preferably 1-18 carbons, as exemplified by ethyl, butyl, pentyl, cyclohexyl, octyl, dodecyl, heptadecyl, octadecyl, etc. These alkyl groups may have substituents such as aryl, alkoxy, alkoxycarbonyl, aryloxycarbonyl, carbamoyl, sulfamoyl, etc.

The aryl group represented by $R_1$, $R_2$ and $R_3$ may be a phenyl or naphthyl group, which may optionally have substituents such as an alkyl group having 1-18 preferably 1-12, carbon atoms, an alkoxy group having 1-12 carbon atoms, an amino group which is optionally substituted with one or two alkyl groups having 1-12 carbon atoms, or with an acyl group having 1-12 carbon atoms, a halogen atom, or a hydroxy group.

The compounds represented by the general formula (TO) which may be used in the present invention include, but are not limited to, the following examples.

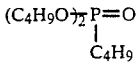

(TO-1)

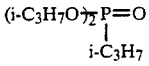

(TO-2)

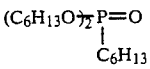

(TO-3)

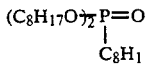

(TO-4)

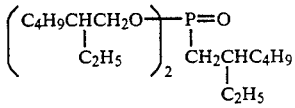

(TO-5)

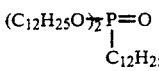

(TO-6)

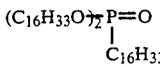

(TO-7)

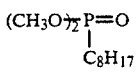

(TO-8)

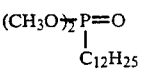

(TO-9)

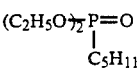

(TO-10)

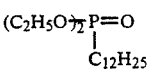

(TO-11)

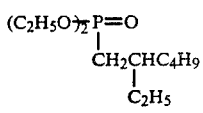

(TO-12)

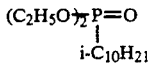

(TO-13)

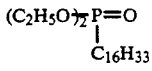

(TO-14)

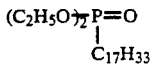

(TO-15)

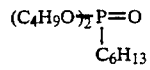

(TO-16)

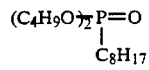

(TO-17)

-continued
(TO-18)
$(C_4H_9O)_2P(=O)C_{12}H_{25}$
(TO-19)
$(C_4H_9O)_2P(=O)C_{14}H_{29}$
(TO-20)
$(C_6H_{13}O)_2P(=O)\text{i-}C_3H_7$
(TO-21)
$(C_6H_{13}O)_2P(=O)CH_2CH(C_2H_5)C_4H_9$
(TO-22)
$(C_4H_9CH(C_2H_5)CH_2O)_2P(=O)C_4H_9$
(TO-23)
$[(CH_3)_3CCH_2CH(CH_3)CH_2CH_2O)]_2P(=O)C_4H_9$
(TO-24)
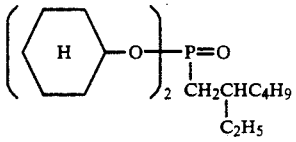
(TO-25)
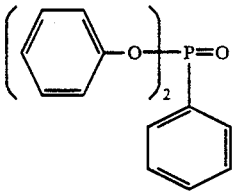
(TO-26)
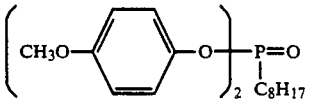
(TO-27)
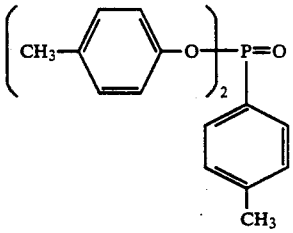
(TO-28)
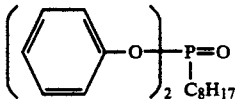
(TO-29)
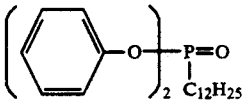
-continued
(TO-30)
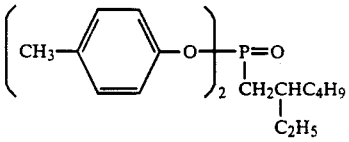
(TO-31)
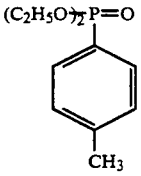
(TO-32)
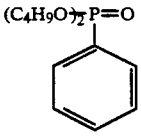
(TO-33)
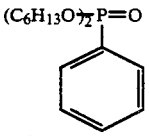
(TO-34)
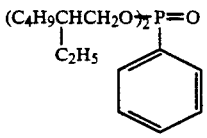
(TO-35)
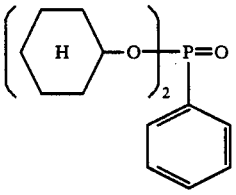
(TO-36)
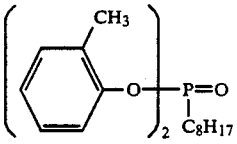
(TO-37)
$(C_2H_5O)_2P(=O)CH_2CH_2CH_2OC_{12}H_{25}$
(TO-38)
$(C_4H_9O)_2P(=O)CH_2CH_2COCH_2CH_2CH_3$
(TO-39)
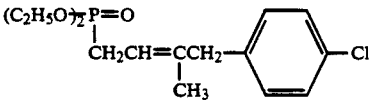
(TO-40)
$(C_4H_9O)(C_2H_5O)P(=O)C_{12}H_{25}$
(TO-41)
$(C_4H_9O)_2P(=O)(CH_2)_{10}COOC_2H_5$ -continued (TO-42)

$(C_2H_5O)_2P(=O)-CH_2CH_2COOC_{14}H_{29}$ (TO-43)

$(C_6H_{13}O)_2P(=O)-CH_2CH_2OCOC_8H_{17}$ (TO-44)

$(C_4H_9O)_2P(=O)-(CH_2)_{10}COOCH_2CH(C_2H_5)C_4H_9$ (TO-45)

$(C_4H_9O)_2P(=O)-CH(CH_2)_{11}CH_3-COOCH_2CH(C_2H_5)C_4H_9$ (TO-46)

$(C_2H_5O)_2P(=O)-(CH_2)_{10}CON(C_2H_5)_2$ (TO-47)

$(C_4H_9O)_2P(=O)-CH_2CH_2CON(CH_2CH(C_2H_5)C_4H_9)_2$ (TO-48)

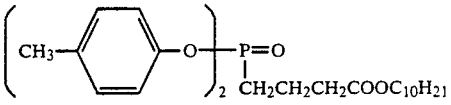

(TO-49)

$(C_4H_9CH(C_2H_5)CH_2O)_2P(=O)-(CH_2)_{10}CON(C_2H_5)_2$ (TO-50)

$(i\text{-}C_4H_9O)_2P(=O)-(CH_2)_8COO-C_6H_4$ (TO-51)

$(C_4H_9O)_2P(=O)-CH_2CH_2SO_2N(C_4H_9)_2$ (TO-52)

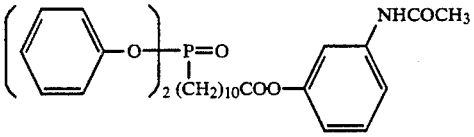

(TO-53)

$(C_6H_{13}O)_2P(=O)-CH(C_6H_{13})COOC_4H_9$ (TO-54)

$(C_4H_9O)_2P(=O)-CH(CH_2COOCH_2CH(C_2H_5)C_4H_9)-COOCH_2CH(C_2H_5)C_4H_9$

-continued (TO-55)

$(C_4H_9CH(C_2H_5)CH_2)_2P(=O)-OCH_2CH(C_2H_5)C_4H_9$ (TO-56)

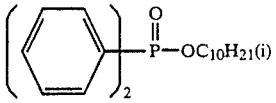

(TO-57)

$(C_6H_{13})_2P(=O)-O-C_6H_4-CH_3$ (TO-58)

$[C_2H_5OCO(CH_2)_{10}]_2P(=O)-OC_4H_9$ (TO-59)

$[(C_4H_9)_2NCO(CH_2)_8]_2P(=O)-OC_{12}H_{25}$ (TO-60)

$(C_{12}H_{25})_2P(=O)-O-C_6H_5$ (TO-61) $(C_2H_5)_3P=O$ (TO-62) $(C_4H_9)_3P=O$ (TO-63) $(i\text{-}C_4H_9)_3P=O$ (TO-64) $(C_5H_{11})_3P=O$ (TO-65) $(C_6H_{13})_3P=O$ (TO-66) $(C_8H_{17})_3P=O$ (TO-67) $(C_4H_9CH(C_2H_5)CH_2)_3P=O$ (TO-68) $[(CH_3)_3CCH_2CH(CH_3)CH_2CH_2]_3P=O$ (TO-69) $(C_{10}H_{21})_3P=O$ (TO-70) $(i\text{-}C_{10}H_{21})_3P=O$ (TO-71) $(C_{12}H_{25})_3P=O$ (TO-72) $(C_{14}H_{29})_3P=O$ (TO-73) $(C_{17}H_{33})_3P=O$ (TO-74)

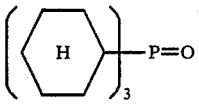

(TO-75)

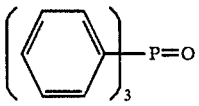

(TO-76)

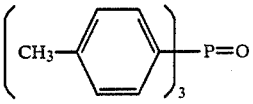

-continued (TO-77)

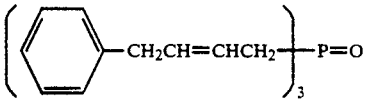

(TO-78)

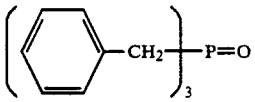

(TO-79) $[C_4H_9OCO(CH_2)_{10}]_3P{=}O$ (TO-80) $[(C_2H_5)_2NCO(CH_2)_{10}]_3P{=}O$ (TO-81)

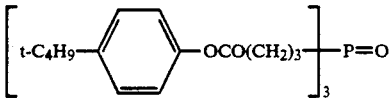

(TO-82) $(C_2H_5)_2\overset{O}{\overset{\|}{P}}{-}C_{12}H_{25}$ (TO-83) $(C_4H_9)_2\overset{O}{\overset{\|}{P}}{-}CH_2CH_2COOCH_2\underset{C_2H_5}{\underset{|}{C}}HC_4H_9$ (TO-84)

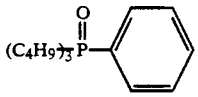

(TO-85)

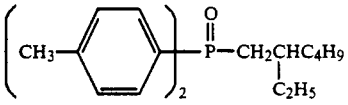

(TO-86) $(C_8H_{17}O)_2\underset{CH_2CH_2O}{\underset{|}{P}}{=}O{-}C_6H_4{-}N(CH_3)_2$ (TO-87) $(CH_3COOCH_2CH_2OCH_2CH_2O)_2\underset{C_{18}H_{37}}{\underset{|}{P}}{=}O$ (TO-88)

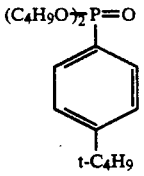

(TO-89)

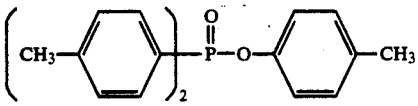

(TO-90)

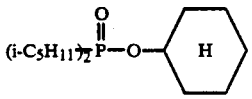

The high-boiling point organic solvents are preferably used in amounts ranging from 0.1 to 10 ml, more preferably from 0.1 to 5 ml, per gram of the coupler. These organic solvents may be used in combination with other high-boiling point organic solvents that boil at temperatures not lower than 150° C. and that will not react with the oxidation products of developing agents, as exemplified by phenolic derivatives, phthalic acid esters, phosphoric acid esters, citric acid esters, benzoic acid esters, alkylamides, aliphatic acid esters and trimesic acid esters.

When the light-sensitive material of the present invention is to be used for multicolor photography, pyrazolone based compounds may be used as magenta couplers, and phenolic or naphtholic compounds as cyan couplers.

A preferred arrangement of silver halide emulsion layers is such that a support is successively coated with a blue-sensitive silver halide emulsion layer containing a yellow coupler, a green-sensitive silver halide emulsion layer containing a magenta coupler, a red-sensitive silver halide emulsion layer containing a cyan coupler. More specifically, it is preferred for the purposes of the present invention that the support is successively coated with the following essential layers, ie., a blue-sensitive silver halide emulsion layer containing the yellow coupler of the general formula (Y-1) and the compound of the general formula (T) according to the present invention, a green-sensitive silver halide emulsion layer containing a magenta coupler, a non-light-sensitive intermediate layer containing a uv absorber, a red-sensitive silver halide emulsion layer containing a cyan coupler, a non-light-sensitive layer containing a uv absorber, and a protective outermost layer.

Supports that can preferably be used in the present invention include a resin-coated paper base and a polyethylene terephthalate base containing a white pigment.

It is preferable to use uv absorbers represented by the following general formula (U):

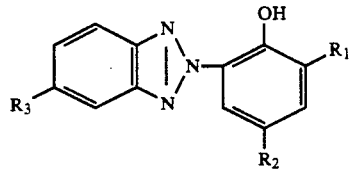

(U)

where $R_1$, $R_2$ and $R_3$ each independently represents a hydrogen atom, a halogen atom, an alkyl group, an aryl group, an alkoxy group, an aryloxy group, an alkenyl group, a nitro group or a hydroxyl group.

The groups represented by $R_1$–$R_3$ may have substituents. Preferred amounts of $R_1$ and $R_2$ include a hydrogen atom, an alkyl group, an alkoxy group and an aryl group, with a hydrogen atom, an alkyl group and an alkoxy group being particularly preferred. Particularly preferred examples of $R_3$ include a hydrogen atom, a halogen atom, an alkyl group and an alkoxy group.

Preferably, at least one of $R_1$–$R_3$ is an alkyl group. More preferably, at least two of $R_1$–$R_3$ are an alkyl group. It is also preferred that at least one of $R_1$–$R_3$ is a branched alkyl group.

Typical example of the uv absorber prepresented by the general formula (U) are listed below:

U-1

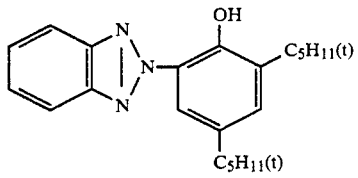

U-2

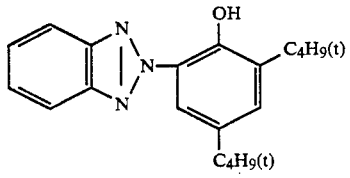

U-3

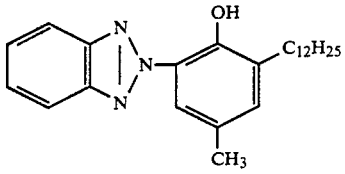

U-4

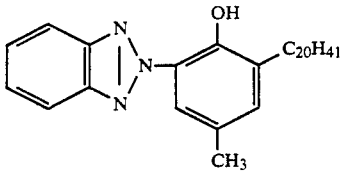

The compound represented by the general formula (U) is preferably used in amounts ranging from 0.1 to 300 wt %, more preferably from 1 to 200 wt %, of the binder in the layer that contains said compound.

It is particularly preferred to use the uv absorber represented by the general formula (U-1):

Any of the silver halides that are commonly used in ordinary silver halide emulsions, such as silver bromide, silver iodobromide, silver iodochloride, silver chlorobromide and silver chloride, may be incorporated in the silver halide emulsions in the silver halide photographic material of the present invention. Silver halide grains having a silver chloride content of at least 90 mol % are preferably used, with the silver bromide and silver iodide contents being preferably not more than 10 mol % and 0.5 mol %, respectively. Silver chlorobromide grains with a silver bromide content of 0.1–2 mol % are more preferred.

In the present invention, silver halide grains may be used either independently or in admixture with other silver halide grains having different compositions. If desired, they may be used in admixture with silver halide grains having a silver chloride content of not more than 90 mol %.

If silver halide grains having a silver chloride content of not less than 90 mol % are to be incorporated in a silver halide emulsion layer, those silver halide grains generally occupy at least 60 wt %, preferably at least 80 wt %, of the total silver halide grains in said emulsion layer.

The silver halide grains to be used in the present invention may have a homogeneous distribution of silver halide composition throughout the grain, or they may have different silver halide compositions in the interior and surface layer of the grain. In the latter case, the change in silver halide composition may be gradual or abrupt.

The particle size of the silver halide grains for use in the present invention is not limited to any particular value but, in consideration of the rapidity of processing, sensitivity and other factors of photographic performance, the grain is preferably within the range of 0.2–1.6 μm, more preferably within the range of 0.25–1.2 μm. The grain size described above can be determined by any of the methods conventionally used in the art, and typical techniques are described in Loveland, "Particle Size Analyses" in ASTM Symposium on Light Microscopy, 1955, pp. 94–122, and in "The Theory of the Photographic Process", ed. by Mees and James, 3rd Edition, The Macmillan Company, 1966, Chapter 2.

Generally, grain size measurements can be made in terms of the projected area of particles or the diameters of equivalent circles. Of the particles are substantially uniform in shape, their size distribution can be expressed fairly accurately in terms of either the diameter or the projected area.

The particle size distribution of the silver halide grains to be used in the present invention may be polydispersed or monodispersed. Monodispersed silver halide grains in which the variation coefficient of their particle size distribution is 0.22 or below are preferred, with those having a variation coefficient of 0.15 or below being more preferred. The variation coefficient means a coefficient that denotes the breadth of particle size distribution and is defined by the following formulas:

$$\text{Variation coefficient} = \frac{S}{r};$$

$$S = \text{the standard deviation of particle size distribution} = \sqrt{\frac{\Sigma (r - ri)^2 ni}{\Sigma ni}};$$

$$r = \text{mean particle size} = \frac{\Sigma niri}{\Sigma ni}$$

where ri is the size of the each silver halide grain, and ni is the number of grains having the size ri. The term "grain size" or "particle size" as used herein means the diameter if the silver halide grains of interest are spherical, and the diameter of a circle of the same area as the projected image or cubic or other non-spherical grains.

The silver halide grains to be used in emulsions in accordance with the present invention may be prepared by any of the acid, neutral and ammoniacal methods. These grains may be grown in one step or they may be grown from seeds. The method of forming seed grains may be the same as or different from what is used to grow them.

Soluble silver salts may be reacted with soluble halide salts by any method such as normal precipitation, reverse precipitation, double-jet precipitation or combinations of these methods. Preferably, the two types of salts are reacted by double-jet precipitation. A useful version of the double-jet precipitation is the pAg controlled double-jet method described in Japanese Patent Public Disclosure No. 48521/1979, etc.

If necessary, silver halide solvents such as thioether may be used. Further, mercapto group containing compounds, nitrogenous heterocyclic compounds or sensitizing dyes may also be used either during or after the formation of silver halide grains.

The silver halide grains to be used in the present invention may have any crystallographic shapes. A preferred example is cubes having {100} crystal faces. It is also possible to use octahedral, tetradecahedral, dodecahedral or otherwise shaped crystals that are prepared by the methods described in such references as U.S. Pat. Nos. 4,183,756, 4,225,666, Japanese Patent Public Disclosure No. 26589/1980, Japanese Patent Publication No. 42737/1980 and The Journal of Photographic Science, 21, 39 (1973). Grains having twinned faces may also be used. The silver halide grains to be used in the present invention may have a single shape or they may be mixtures of variously shaped grains.

In the process of formation and/or growth of silver halide grains to be used in a silver halide emulsion, at least one metal ionic species selected from the group consisting of cadmium salt, zinc salt, lead salt, thallium salt, iridium salt (or a complex salt containing the same), a rhodium salt (or a complex salt containing the same) and an iron salt (or a complex salt containing the same) may be added so that these metallic elements may be present within and/or on the grains. Alternatively, the grains may be placed in a suitable reducing atmosphere so as to provide reduction sensitization nuclei within and/or on the grains.

In preparing emulsions containing silver halide grains to be used in the present invention (said emulsions are hereinafter referred to as the "emulsions of the present invention"), unwanted soluble salts may be removed after completion of the growth of silver halide grains. If desired, such soluble salts may be left unremoved from the grown silver halide grains. Removal of such soluble salts may be accomplished by the method described in Research Disclosure No. 17643.

The silver halide grains to be used in the emulsions of the present invention may be either such that latent image is predominantly formed on their surface or such that it is predominantly formed within the grain. The former type of grains is preferred.

The emulsions of the present invention are chemically sensitized in the usual manner.

After exposure, the light-sensitive material of the present invention is subjected to photographic processing including at least a color development step and a desilvering step in order to produce a dye image. Preferably, the exposed light-sensitive material is first subjected to color development, then bleach-fixed before it is washed with water or stabilized.

In the step of color development, color developing agents are usually incorporated in color developers. According to the present invention, part or all of the color developing agent may be incorporated in the color photographic material, which is to be processed with a color developer that may or may not contain the same color developing agent.

The color developing agent to be incorporated in the color developer is selected from among aromatic primary amino color developing agents which encompass aminophenolic and p-phenylenediamino derivatives, with the latter being particularly preferred. These color developing agents may be used as salts of organic or inorganic acids. Illustrative salts include hydrochlorides, sulfates, p-toluenesulfonates, sulfites, oxalates and benzene-sulfonates. These compounds are used at concentrations that generally range from about 0.1 g to about 30 g, more preferably from about 1 g to about 15 g, per liter of color developer.

Particularly useful primary aromatic amino color developing agents are N,N-dialkyl-p-phenylenediamino compounds, in which the alkyl and phenyl groups may have any suitable substituents. Particularly useful compounds may be exemplified by, for example, N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethyl-aminoaniline, 4-amino-3-methyl-N,N-diethylaniline, and 4-amino-N-)2-methoxyethyl)N-ethyl-3-methylaniline-p-toluenesulfonate.

The color developing agents described above may be used either on their own or as admixtures. The color developers may contain commonly used alkali agents such as sodium hydroxide, potassium hydroxide, ammonium hydroxide, sodium carbonate, potassium carbonate, sodium phosphate, sodium metaborate and borax. Other additives that may be incorporated in the color developers include alkali metal halides (e.g. potassium bromide and potassium chloride), development controlling agents (e.g. citrazinic acid), preservatives (hydroxylamine, polyethyleneimine and glucose), and sulfites (e.g. sodium sulfite and potassium sulfite). The color developers may further contain various defoamers, surfactants, methanol, N,N-dimethylformamide, ethylene glycol, diethylene glycol, dimethyl sulfoxide and benzyl alcohol. Preferably, the light-sensitive material of the present invention is processed with a color developer that is substantially free from benzyl alcohol and that contains a sulfite in an amount not exceeding $2\times10^{-2}$ moles per liter. A more preferred range of the sulfite concentration is from $1\times10^{-4}$ to $1.7\times10^{-2}$ moles per liter, with the range of $5\times10^{-3}$ to $1\times10^{-2}$ mole per liter being particularly preferred. The expression "substantially free from benzyl alcohol" means that benzyl alcohol is present at a concentration less than 0.5 ml/L, and the complete absence of benzyl alcohol is preferred.

The pH of the color developer is usually at least 7, preferably in the range of from 9 to 13.

The processing solution in the color developing bath preferably has a temperature of 10°-65° C., with the range of 25°-45° C. being more preferred. The development time is preferably within 2 minutes and a half, more preferably within 2 minutes.

After color development, the silver halide color photographic material of the present invention is usually subjected to a bleaching treatment. Bleaching may be performed simultaneously with a fixing treatment (bleach-fixing) or it may be separate from the latter. Preferably, a bleach-fixing bath which is capable of simultaneous bleaching and fixing in a single bath is employed. The pH of the bleach-fixing solution is preferably in the range of 4.5-6.8, with the range of 4.5-6.0 being particularly preferred.

The bleaching agent that can be used in the bleach-fixing solution is preferably selected from among metal complex salts of organic acids. Particularly preferred are those complex salts in which the ions of metals such as iron, cobalt and copper are coordinated with aminopolycarboxylic acids or organic acids such as oxalic acid and citric acid.

Additives that can be incorporated in bleach-fixing solutions include rehalogenating agents such as alkali halides and ammonium halides (e.g. potassium bromide, sodium bromide, sodium chloride and ammonium bromide), metal salts and chelating agents. Further, pH buffers (e.g., borates, oxalates, acetates, carbonates and phosphates), alkylamines, polyethylene oxides and other additives that are known to be capable of being incorporated in bleaching solutions may appropriately be added to the bleach-fixing solution for use in the present invention. One or more pH buffers may be incorporated in the bleach-fixing solution and they are comprised of sulfites such as ammonium sulfite, potassium sulfide, ammonium bisulfite, potassium bisulfite, sodium bisulfite, ammonium metabisulfite, potassium metabisulfite and sodium metabisulfite, boric acid, acetic acid, borax, sodium hydroxide, potassium hydroxide, sodium carbonate, potassium carbonate, sodium bicarbonate, potassium bi-carbonate, sodium acetate and ammonium hydroxide.

The following examples are provided for the purpose of further illustrating the present invention but are in no way to be taken as limiting.

EXAMPLE 1

Preparation of Sample 1

Solutions having couplers and, optionally, image dye stabilizers and anti-stain agents dissolved in both high-boiling point solvents and ethyl acetate were added to an aqueous gelatin solution containing a dispersion aid and dispersed by means of an ultrasonic homogenizer. To the resulting dispersions, coating gelatin solutions and light-sensitive silver halide emulsions were added to prepare solutions for coating emulsion layers.

A paper base was laminated with polyethylene on the side and with a $TiO_2$-containing polyethylene on the other side which was to be coated with the first photographic layer. The resulting support was coated with the photographic layers having the compositions described in Table 1, whereby sample No. 1 of multi-layered silver halide color photographic material was prepared.

The silver halide emulsions used were prepared by the following procedures. Preparation of blue-sensitive silver halide emulsion:

To 1,000 ml of a 2% aqueous gelatin solution held at 40° C., solutions A and B (for their recipes, see below) were added simultaneously over a period of 30 minutes with the pAg and pH being controlled at 6.5 and 3.0, respectively. Further, solutions C and D (for their recipes, see below) were added simultaneously over a period of 180 minutes with the pAg and pH being controlled at 7.3 and 5.5, respectively.

In the procedure described above, pAg control was performed by the method described in Japanese Patent Public Disclosure No. 45437/1984 whereas pH control was performed by addition of sulfuric acid or sodium hydroxide in aqueous solution.

| | |
|---|---|
| Solution A | |
| NaCl | 3.42 g |
| KBr | 0.03 g |
| Water | to make 200 ml |
| Solution B | |
| $AgNO_3$ | 10 g |
| Water | to make 200 ml |

-continued

| | |
|---|---|
| Solution C | |
| NaCl | 102.7 g |
| KBr | 1.0 g |
| Water | to make 600 ml |
| Solution D | |
| $AgNO_3$ | 300 g |
| Water | to make 600 ml |

After addition of solutions A–D, desalting was performed by adding a 5% aqueous solution of "Demor N" of Kao-Atlas Company, Ltd. and a 20% aqueous solution of magnesium sulfate. By subsequent mixing with an aqueous gelatin solution, a monodispersed cubic emulsion EMP-1 having an average grain size of 0.85 μm, a variation coefficient ($S/\bar{r}$) of 0.07 and a AgCl content of 99.5 mol % was obtained.

This emulsion EMP-1 was chemically ripened with the compounds listed below at 50° C. for 90 minutes to prepare a blue-sensitive silver halide emulsion (EmA):

| | |
|---|---|
| Sodium thiosulfate | 0.8 mg/mol AgX |
| Chloroauric acid | 0.5 mg/mol AgX. |
| Stabilizer (SB-5) | $6 \times 10^{-4}$ mol/mol AgX |
| Sensitizing dye (D-1) | $5 \times 10^{-4}$ mol/mol AgX |

Preparation of green-sensitive silver halide emulsion:

A monodispersed cubic emulsion EMP-2 having an average grain size of 0.43 μm, a variation coefficient ($S/\bar{r}$) of 0.08 and a AgCl content of 99.5 mol % was obtained by repeating the procedure for the preparation of EMP-1 except that the time over which solutions A and B were added and the time over which solutions C and D were added were changed.

The emulsion EMP-2 was chemically ripened with the compounds listed below at 55° C. for 120 minutes to prepare a green-sensitive silver halide emulsion(EmB):

| | |
|---|---|
| Sodium thiosulfate | 1.5 mg/mol AgX |
| Chloroauric acid | 1.0 mg/mol AgX |
| Stabilizer (SB-5) | $6 \times 10^{-4}$ mol/mol AgX |
| Sensitizing dye (D-2) | $4.0 \times 10^{-4}$ mol/mol AgX |

Preparation of red-sensitive silver halide emulsion:

A monodispersed cubic emulsion EMP-3 having an average grain size of 0.50 μm, a variation coefficient ($S/\bar{r}$) of 0.08 and a AgCl content of 99.5 mol % was obtained by repeating the procedure for the preparation of EMP-1 except that the time over which solutions A and B were added and the time over which solutions C and D were added were changed.

The emulsion EMP-3 was chemically ripened with the compounds listed below at 60° C. for 90 minutes to prepare a red-sensitive silver halide emulsion(EmC):

| | |
|---|---|
| Sodium thiosulfate | 1.8 mg/mol AgX |
| Chloroauric acid | 2.0 mg/mol AgX |
| Stabilizer (SB-5) | $6 \times 10^{-4}$ mol/mol AgX |
| Sensitizing dye (D-3) | $8.0 \times 10^{-4}$ mol/mol AgX |

D-1

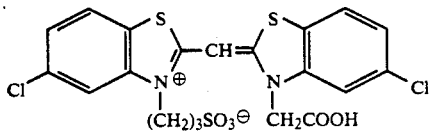

D-2

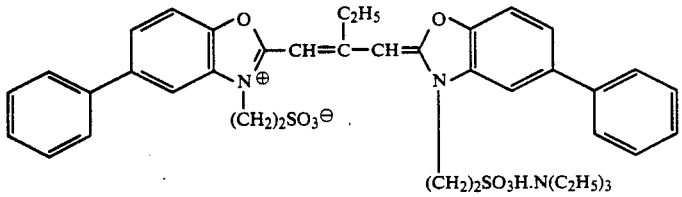

D-3

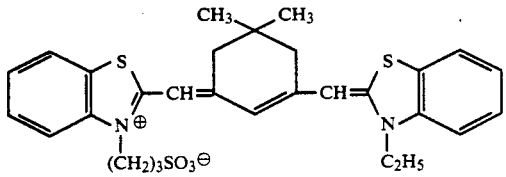

SB-5

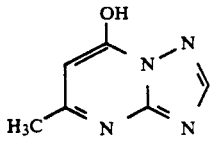

TABLE 1-1

| Layer | Composition | Amount of addition, g/m$^2$ |
|---|---|---|
| Seventh layer (protective layer) | gelatin | 1.0 |
| Sixth layer (uv absorbing layer) | gelatin | 0.6 |
| | uv absorber (UV-1) | 0.2 |
| | uv absorber (UV-2) | 0.2 |
| | anti-color mixing agent (HQ-1) | 0.01 |
| | S-5 | 0.2 |
| | PVP | 0.03 |
| | anti-irradiation dye (AI-2) | 0.02 |
| Fifth layer (red sensitive layer) | gelatin | 1.40 |
| | red-sensitive AgClBr emulsion (EmC) | 0.24 (as Ag) |
| | cyan coupler (C-1) | 0.17 |
| | cyan coupler (C-2) | 0.25 |
| | image dye stabilizer (ST-1) | 0.20 |
| | high-boiling point organic solvent (HB-1) | 0.10 |
| | anti-stain agent (HQ-1) | 0.01 |
| | S-2 | 0.30 |
| Fourth layer (uv absorbing layer) | gelatin | 1.30 |
| | uv absorber (UV-1) | 0.40 |
| | uv absorber (UV-2) | 0.40 |
| | anti-color mixing agent (HQ-1) | 0.03 |
| | S-5 | 0.40 |

TABLE 1-2

| Layer | Composition | Amount of addition, g/m$^2$ |
|---|---|---|
| Third layer (green-sensitive layer) | gelatin | 1.40 |
| | green-sensitive AgClBr emulsion (EmB) | 0.27 (as Ag) |
| | magenta coupler (M-1) | 0.35 |
| | antioxidant (AO-1) | 0.20 |
| | dye image stabilizer (ST-4) | 0.10 |
| | high-boiling point organic solvent (DOP) | 0.30 |
| | anti-irradiation dye (AI-1) | 0.01 |
| Second layer (intermediate layer) | gelatin | 1.20 |
| | anti-color mixing agent (HQ-1) | 0.12 |
| | S-7 | 0.15 |
| First layer (blue-sensitive layer) | gelatin | 1.30 |
| | blue-sensitive AgClBr emulsion (EmB) | 0.30 (as Ag) |
| | yellow coupler (Y-1) | 0.80 |
| | dye image stabilizer (ST-2) | 0.20 |
| | anti-stain agent (HQ-1) | 0.02 |
| | high-boiling point organic solvent (DBP) | 0.20 |
| Support | polyethylene-laminated/paper | |

Y-1
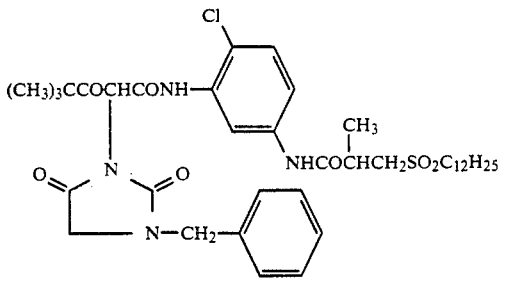
(M-1)
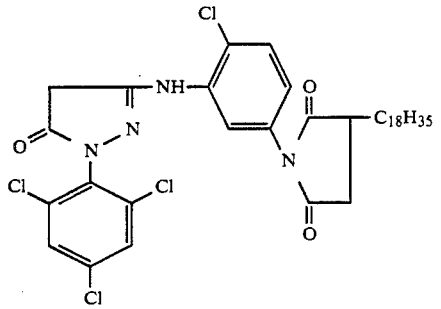
C-1
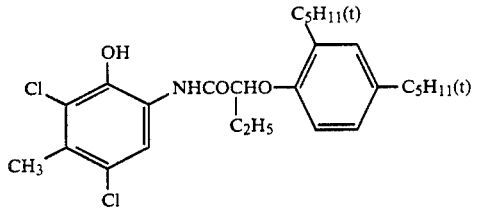
C-2
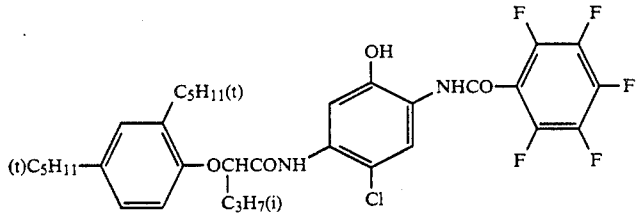
ST-1
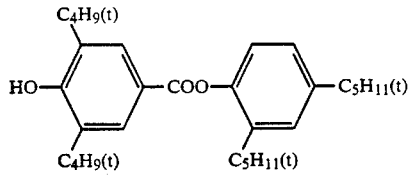
ST-2
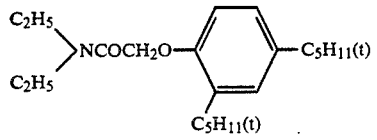
A
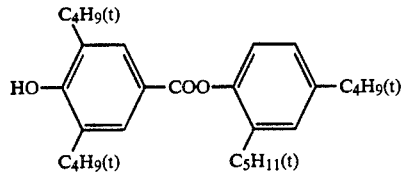
(dibutyl phthalate) DBP
(polyvinylpyrrolidon) PVP -continued
UV-1
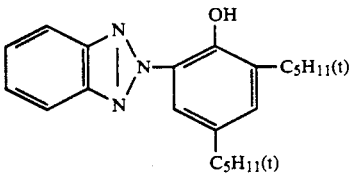
UV-2
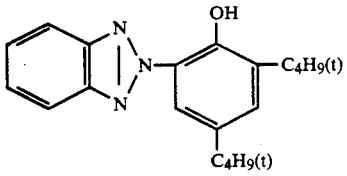
HQ-1
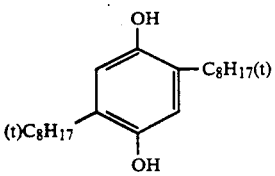
AO-1
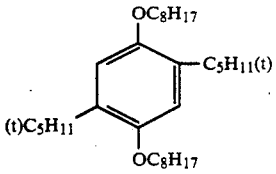
ST-4
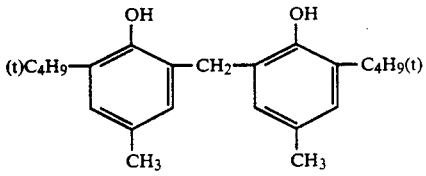
AI-1
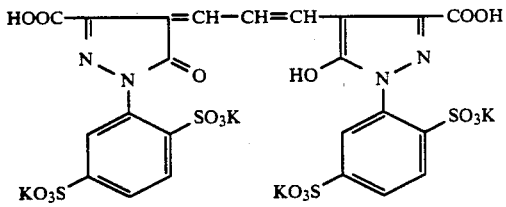
AI-2
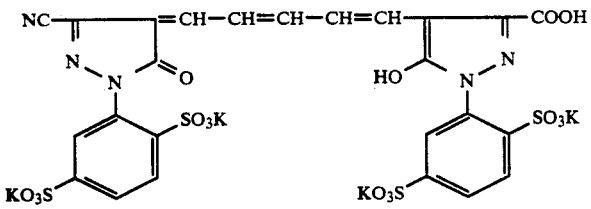
HB-1
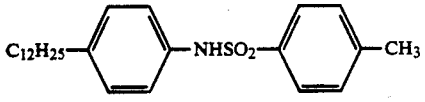
Sample 1 was exposed to blue light through an optical wedge in the usual manner and subsequently processed by the following scheme.
| Step | Temperature, °C. | Time, sec |
|---|---|---|
| Color development | 35.0 ± 0.3 | 45 |
| Bleach-fixing | 35.0 ± 0.3 | 45 |
-continued
| Step | Temperature, °C. | Time, sec |
|---|---|---|
| Stabilization | 30–34 | 90 |
| Drying | 60–80 | 60 |
Processing solutions:

| | |
|---|---|
| Color developer | |
| Triethanolamine | 10 g |
| N,N-Diethylhydroxylamine | 5 g |
| Potassium bromide | 0.02 g |
| Potassium chloride | 2 g |
| Potassium sulfite | 0.3 g |
| 1-Hydroxyethylidene-1,1-diphsphonic acid | 1.0 g |
| Ethylenediaminetetraacetic acid | 1.0 g |
| Catechol-3,5-disulfonic acid disodium salt | 1.0 g |
| N-Ethyl-N-β-methanesulfonamidoethyl-3-methyl-4-aminoaniline sulfate | 4.5 g |
| Brightener (4,4'-diaminostilbene disulfonic acid derivative) | 1.0 g |
| Potassium carbonate | 27 g |
| Water | to make 1,000 ml |
| pH | adjusted to 10.10 |
| Bleach-fixing solution | |
| Ethylenediaminetetraacetic acid iron (II) ammonium dihydrate | 60 g |
| Ethylenediaminetetraacetic acid | 3 g |
| Ammonium thiosulfate (70% aq. sol.) | 100 ml |
| Ammonium sulfite (40% aq. sol.) | 27.5 ml |
| Water | to make 1,000 ml |
| pH adjusted to 5.7 with potassium carbonate or glacial acetic acid | |
| Stabilizing solution | |
| 5-Chloro-2-methyl-4-isothiazolin-3-one | 1.0 g |
| Ethylene glycol | 1.0 g |
| 1-Hydroxyethlidene-1,1-diphosphonic acid | 2.0 g |
| Ethylenediaminetetraacetic acid | 1.0 g |
| Ammonium hydroxide (20% aq. sol.) | 3.0 g |
| Ammonium sulfite | 3.0 g |
| Brightener (4,4'diaminostilbene disulfonic acid derivative) | 1.5 g |
| Water | to make 1,000 ml |
| pH adjusted to 7.0 with sulfuric acid or potassium hydroxide | |

Preparation of Samples 2–19

Sample Nos. 2–19 were prepared by repeating the procedure for the preparation of sample No. 1 except that the yellow coupler (Y-1) and the high-boiling point organic solvent (DBP) incorporated in the first layer were changed to those listed in Table 2 and that the dye image stabilizer was added as shown in Table 2. The thus prepared samples were exposed and processed as in the case of sample No. 1.

All of the processed samples having a yellow dye image were evaluated for color fastness to light, processability at high temperatures and color sharpness by the following procedures:

Test for color fastness to light:

The samples were mounted on an Underglass outdoor sunlight exposure table and exposed to sunlight for 14 days. The percent fading was calculated by the following formula, with the initial image density being taken as 1.0:

Percent fading = (1.0 − density after fading) × 100

Processability at high temperatures:

The samples were immersed in a thermostatic bath at 85% r.h. and the increase in the density of the area having an initial density of 1.0 was determined.

Color sharpness:

The visible absorption spectrum of the area having a density of 1.0 at maximum absorption wavelength was measured, and the color sharpness on the longer wavelength side was evaluated by measuring the wavelength ($\lambda_{0.5}$) at which the density 0.5 was attained.

The results of the evaluations are shown in Table 2.

TABLE 2

| Sample | Yellow coupler | Image stabilizer | Amount, mole | HBS | Percent fading | Increase in density | Color sharpness, nm | Remarks |
|---|---|---|---|---|---|---|---|---|
| 1 | Y-1 | — | — | DBP | 25 | 0 | 506 | Comparison |
| 2 | Y-1 | ST-1 | 3.0 | DBP | 13 | 0.08 | 505 | |
| 3 | Y-1 | A | 3.0 | DBP | 12 | 0.05 | 505 | |
| 4 | Y-1-3 | — | — | DBP | 26 | 0 | 499 | |
| 5 | Y-1-3 | ST-1 | 3.0 | DBP | 13 | 0.08 | 499 | |
| 6 | Y-1-3 | T-4 | 1.8 | DBP | 10 | 0 | 497 | Sample of the present invention |
| 7 | Y-1-3 | T-10 | 1.8 | DBP | 10 | 0 | 497 | |
| 8 | Y-1-3 | T-8 | 1.8 | DBP | 9 | 0 | 497 | |
| 9 | Y-1-3 | T-11 | 1.8 | DBP | 9 | 0 | 497 | |
| 10 | Y-1-51 | T-4 | 1.8 | DBP | 10 | 0 | 499 | |
| 11 | Y-1-1 | T-4 | 1.8 | DBP | 10 | 0 | 499 | |
| 12 | Y-1-3 | T-4 | 1.8 | S-5 | 7 | 0 | 497 | |
| 13 | Y-1-3 | T-24 | 1.8 | DBP | 5 | 0 | 496 | |
| 14 | Y-1-3 | T-25 | 1.8 | DBP | 6 | 0 | 496 | |
| 15 | Y-1-3 | T-22 | 1.8 | DBP | 6 | 0 | 496 | |
| 16 | Y-1-3 | T-4 | 1.8 | S-2 | 8 | 0 | 497 | |
| 17 | Y-1-3 | T-4 | 1.8 | TCP | 11 | 0 | 497 | |
| 18* | Y-1-3 | T-4 | 1.8 | S-5 | 11 | 0 | 498 | |
| 19** | Y-1-3 | T-4 | 1.8 | S-5/TO-66 | 7 | 0 | 495 | |

HBS: high-boiling point organic solvent
Amount: Expressed in terms of the number of moles per mole of the coupler in the same layer
TCP: tricresyl phosphate
*Without ST-2 in the first layer
**S-5/TO-66 = 1:1 (by weight)

As is clear from Table 2, the samples of the present invention were satisfactory in terms of color fastness to light, processability at high temperatures and color sharpness. Particularly good results were attained both in the case where high-boiling point organic solvents having low dielectric constants were used and in the case where compounds of the general formula (T) were used in combination with other dye image stabilizers. The use of the compound represented by the general formula (TO) was effective in providing much better results in color sharpness.

It was also confirmed by experimentation that the advantages of the present invention were attained with the following four additional types of samples: i) samples using TO-68, TO-86, TO-55 and TO-4 in place of TO-66 in sample 19; ii) a sample using S-12 in place of S-5 in sample 12; iii) samples using Y-I-9, Y-I-10 and Y-I-16 in place of Y-I-3 in sample 16; and iv) samples using T-20, T-29 and T-31 in place of T-24 in sample 13.

What is claimed is:

1. A silver halide color photographic material that has at least one silver halide emulsion layer on a support, which emulsion layer contains a compound represented by the following general formula (T) and a yellow coupler represented by the following general formula (Y-I):

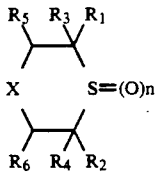

(T)

where $R_1$ $R_2$ are each a hydrogen atom or an alkyl group; $R_3$ and $R_4$ are each a hydrogen atom, an alkyl group, an aryl group or a heterocyclic group; $R_5$ and $R_6$ are each a hydrogen atom, an alkyl group, an aryl group, an acyl group or an alkoxycarbonyl group; X is a divalent group having a carbon atom as a constituent atom of the 6-membered ring; and n is 0, 1 or 2):

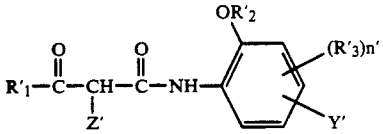

(Y-1)

(where $R'_1$ is an alkyl group or a cycloalkyl group; $R'_2$ is an alkyl group, a cycloalkyl group, an acyl group or an H aryl group; $R'_3$ is a group capable of substitution on the benzene ring; n' is 0 or 1; Y' is a monovalent ballast group, and Z' is a hydrogen atom or an atom or group that is capable of being eliminated upon coupling).

2. The silver halide color photographic material according to claim 1 wherein the compound represented by the general formula (T) is added in an amount of no more than 1.5 g/m$^2$.

3. The silver halide color photographic material according to claim 1 wherein the compound represented by the general formula (T) is added in an amount of 0.01–0.6 g/m$^2$.

4. The silver halide color photographic material according to claim 1 wherein the compound represented by the general formula (Y-I) is added in an amount ranging from $1\times10^{-3}$ to 1 mole per mole of the silver halide.

5. The silver halide color photographic material according to claim 1 wherein the compound represented by the general formula (Y-I) is added in an amount ranging from $1\times10^{-2}$ to $8\times10^{-1}$ moles per mole of the silver halide.

6. The silver halide color photographic material according to claim 1 wherein said silver halide emulsion layer is formed with the aid of a high-boiling point organic solvent.

7. The silver halide color photographic material according to claim 6 wherein said high-boiling point organic solvent is at least one member of the group consisting of esters, organic acid amides, ketones and hydrocarbon compounds.

8. The silver halide color photographic material according to claim 7 wherein said esters are phthalate esters or phosphate esters.

9. The silver halide color photographic material according to claim 8 wherein said phthalate esters are represented by the following general formula (S-1):

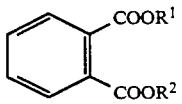

(S-1)

where $R^1$ and $R^2$ each independently represents an alkyl group, an alkenyl group or an aryl group, provided the total sum of carbon atoms in the group represented by $R^1$ and $R^2$ ranges from 12 to 32.

10. The silver halide color photographic material according to claim 9 wherein the total sum of carbon atoms in the groups represented by $R^1$ and $R^2$ ranges from 16 to 24.

11. The silver halide color photographic material according to claim 9 wherein the total sum of carbon atoms in the groups represented by $R^1$ and $R^2$ ranges from 18 to 24.

12. The silver halide color photographic material according to claim 8 wherein said phosphate esters are represented by the following general formula (S-2):

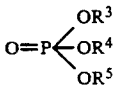

(S-2)

where $R^3$, $R^4$ and $R^5$ each independently represents an alkyl group, an alkenyl group or an aryl group, provided the total sum of carbon atoms in the groups represented by $R^3$, $R^4$ and $R^5$ ranges from 24 to 54.

13. The silver halide color photographic material according to claim 12 wherein the total sum of carbon atoms in the groups represented by $R^3$, $R^4$ and $R^5$ ranges from 27 to 36.

14. The silver halide color photographic material according to claim 6 wherein said high-boiling point organic solvent has a dielectric constant of no more than 6.0° at 30° C.

15. The silver halide color photographic material according to claim 6 wherein said high-boiling point organic solvent has a dielectric constant of 1.9–6.0 at 30° C. and a vapor pressure of no higher than 0.5 mmHg at 100° C.

16. The silver halide color photographic material according to claim 6 wherein said high-boiling point organic solvent is represented by the following general formula (TO):

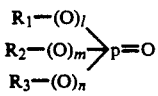

(TO)

where $R_1$, $R_2$ and $R_3$ each independently represents an alkyl group or an aryl group; l, m and n are each 0 or 1, provided they do not assume the value "1" at the same time.

17. The silver halide color photographic material according to claim 6 wherein said high-boiling point organic solvent is used in an amount of 0.1–10 ml per gram of the coupler.

18. The silver halide color photographic material according to claim 6 wherein said high-boiling point organic solvent is used in an amount of 0.1–5 ml per gram of the coupler.

19. The silver halide color photographic material according to claim 1 wherein the silver halide emulsion layer containing the compound represented by the general formula (T) and the yellow coupler represented by the general formula (Y-I) is positioned the closest to the support and is successively overlaid at least with a green-sensitive silver halide emulsion layer containing a magenta coupler, a non-light-sensitive intermediate layer containing a uv absorber, a red-sensitive silver halide emulsion layer containing a cyan coupler, a non-light-sensitive layer containing a uv absorber, and a protective layer.

20. The silver halide color photographic material according to claim 19 wherein said magenta coupler is a pyrazolone based coupler and said cyan coupler is a phenolic or naphtholic coupler.

21. The silver halide color photographic material according to claim 19 wherein said uv absorber is represented by the following general formula (U):

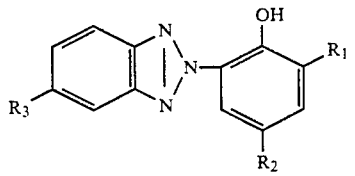

(U)

where $R_1$, $R_2$ and $R_3$ each independently represents a hydrogen atom, a halogen atom, an alkyl group, an aryl group, an alkoxy group, an aryloxy group, an alkenyl group, a nitro group or a hydroxyl group.

22. The silver halide color photographic material according to claim 21 wherein said uv absorber is contained in an amount of 0.1–300 wt % of the binder in the layer which contains said uv absorber.

23. The silver halide color photographic material according to claim 21 wherein said uv absorber is contained in an amount of 1–200 wt % of the binder in the layer which contains said uv absorber.

24. The silver halide color photographic material according to claim 1 wherein said support is a resin-coated paper base or a polyethylene terephthalate base containing a white pigment.

* * * * *